US010134372B2

(12) United States Patent
Brown

(10) Patent No.: US 10,134,372 B2
(45) Date of Patent: Nov. 20, 2018

(54) SYSTEMS TO RAISE PADS OF MUSICAL INSTRUMENTS

(71) Applicant: Key Leaves, Inc., Seattle, WA (US)

(72) Inventor: Nathan Owen Brown, Issaquah, WA (US)

(73) Assignee: KEY LEAVES, INC., Seattle, WA (US)

( * ) Notice: Subject to any disclaimer, the term of this patent is extended or adjusted under 35 U.S.C. 154(b) by 0 days.

(21) Appl. No.: 15/458,856

(22) Filed: Mar. 14, 2017

(65) Prior Publication Data

US 2017/0263218 A1 Sep. 14, 2017

Related U.S. Application Data

(60) Provisional application No. 62/307,713, filed on Mar. 14, 2016.

(51) Int. Cl.
*G10D 9/00* (2006.01)
*G10D 9/04* (2006.01)

(52) U.S. Cl.
CPC ..... *G10D 9/00* (2013.01); *G10D 9/043* (2013.01)

(58) Field of Classification Search
CPC ..... G10D 9/00; G10D 9/043
See application file for complete search history.

(56) References Cited

U.S. PATENT DOCUMENTS

| | | | | |
|---|---|---|---|---|
| 1,691,515 | A | 11/1928 | Gesford | |
| 3,691,893 | A | 9/1972 | Dickson | |
| 5,339,719 | A | 8/1994 | Wasser | |
| 6,242,678 | B1 * | 6/2001 | Williams | G10D 9/043 84/384 |
| 6,972,361 | B2 | 12/2005 | Shibamiya et al. | |
| 7,439,430 | B1 * | 10/2008 | Chang | G10D 7/08 84/380 R |
| 7,459,621 | B2 | 12/2008 | Straubinger | |
| 2017/0263220 | A1 * | 9/2017 | Brown | G10D 9/043 |

OTHER PUBLICATIONS

International Patent Application No. PCT/US2017/22374; Int'l Search Report and the Written Opinion; dated Jul. 11, 2017; 13 pages.
International Patent Application No. PCT/US2017/022374; Written Opinion of the Int'l Preliminary Examining Authority; dated Mar. 30, 2018; 5 pages.
International Patent Application No. PCT/US2017/22374; Int'l Preliminary Report on Patentability; dated Aug. 28, 2018; 22 pages.

* cited by examiner

*Primary Examiner* — Robert W Horn
(74) *Attorney, Agent, or Firm* — Baker & Hostetler LLP

(57) ABSTRACT

Systems for raising pads on musical instruments to enable drying of pads and increase air flow around the pad and a body of the musical instrument. A vent spanner device, including a positioning feature and a retention feature, is placed between a pad and its corresponding vent to create an air gap. A pad prop is placed against a key mechanism or between the key mechanism and/or the body to raise a pad from sealing its corresponding vent. A linkage feature connects one or more vent spanners, pad props, end pieces, key mechanisms, or the body, and provides storage.

30 Claims, 37 Drawing Sheets

SYSTEMS TO RAISE PADS OF MUSICAL INSTRUMENTS

CROSS REFERENCE TO RELATED APPLICATIONS

This application claims benefit under 35 U.S.C. § 119(e) of Provisional Application No. 62/307,713, filed Mar. 14, 2016, the entire contents of which is incorporated herein by reference.

TECHNICAL FIELD

The present disclosure generally relates to the field of musical instruments, particularly wind instruments.

BACKGROUND

Musical instruments that generate sound by forced air, such as saxophones, clarinets, trumpets, flutes, bassoons, oboes, trombones, have vents that the musician closes and opens via a key mechanism to control the flow of moisture or air through the musical instrument from the musician's breath. Names for these vents vary but include "tone hole," "key pad," "valve key," "water key," "drain valve," "whisper key," etc. For the purposes of this disclosure we will refer to these openings simply as vents.

A musician utilizes a key touch to operate a key mechanism to raise and lower one or more pads that opens or closes onto one or more vents to form a seal. When a musical instrument is not being played, some of the pads are in an open position and some of the pads are in a closed position. This configuration is referred to as a normal position of the pad for the purposes of this disclosure. For example, the normal position of the pad for the low D-sharp vent of an alto saxophone is closed, i.e., normally closed; the normal position of the pad for the G vent of a flute is open, i.e., normally open. The pad, usually made of leather or leather-like materials, covers a corresponding vent when closed and forms a tight seal. The contact area of the pad that seals onto the vent is called a "seat."

As an instrument is played, moisture and bacteria collects on the pads and around the vents. When a pad's normal position is closed on the vent, that pad and vent collect moisture and bacteria more quickly. As a result, pads that remain normally closed on vents degrade and stick more often than pads that are designed to remain normally open until the musician closes them. The closed vent can also degrade faster than open vents resulting in corrosive damage and costly repair to the instrument. A sticky pad can cause mechanical malfunctions and interfere with a musician's use of an instrument and affect the quality of the music that can be produced. Musicians therefore have to replace normally closed pads more often than normally open pads.

Some musicians will place a reed from the mouthpiece of a wind instrument, such as a saxophone or clarinet, between a vent and pad to help expose the pad to air. Reeds are typically cut from cane or other fine grained woods, with one flat side and one contoured side. One end of the contoured side is sloped to a thin end point to form the vamp and the other side is rounded along its length to conform to a ligature clamping mechanism of the mouthpiece. The slope of the vamp can make it difficult to properly position/center the reed over a vent hole and maintain that position, as movement of the instrument can cause the reed to lose contact with the vent wall and fall into the vent opening or touch the pad seat causing damage. The flat side of the reed can also cause the reed to slip around and fall out between the pad and vent. The smooth surface of the reed, which makes the reed more comfortable for a player to put in their mouth, also promotes slippage. Reeds are often made from porous cane that can retain moisture, which does not promote drying, and can promote bacterial growth.

U.S. Pat. No. 7,439,430 illustrates an alternative solution to a reed, a flexible wire that has a first end that wraps around the body of the musical instrument and a second end that presses down on a key touch, the finger controls used by a musician to play different notes. By pressing down on a key touch, any pads corresponding to the key touch that are normally closed would be forced open by an amount equal to the pressure applied by the second end. While the flexible wire will work on some key touches of some instruments, it is not a universal solution that can be used on multiple different instruments because many instruments have too much key mechanism in the way for the first end to wrap around the body while also being able to apply sufficient pressure at the second end to keep a key touch pressed down. Further, as the wire extends beyond the perimeter of the instrument, that is designed to fit within a tightly padded case when not in use, it may not be possible to safely put the instrument with the wires attached into the case. Additionally, abrasive damage to the instrument finish may occur over time due to the wire contact and pressure points.

SUMMARY

The present disclosure describes systems for raising pads on musical instruments to prevent pads from sealing corresponding vents and to increase air flow around the pads and body forming the vents so as to enable drying. One system is a vent spanner device that is placed between a pad and its corresponding vent to create an air gap so that air can flow across the pad and into the instrument. The vent spanner comprises a vent spanner bar or section and one or more of a positioning feature and/or a retention feature. A positioning feature may include a vent centering feature which visually identifies a centered position and/or mechanically ensures a centered position. Retention features engage the vent and/or pad and/or resonator to maintain the vent spanner's position and stability while keeping the pad raised. Retention features includes raised or depressed areas, structural shapes, adhesives and the like. Vent spanners can also have a protuberance or other raised or depressed areas on the vent spanner section, which contact the pad or the resonator, and can be positioned by the vent centering feature to avoid contact with a seat of the pad. Variations of the vent spanner device include different shapes and configurations, interchangeable and movable protuberances, a handle for easier manipulation, etc. Vent spanners can be made of virtually any material sufficient to withstand the downward force of a pad, and permit airflow between the pad and vent. Vent spanners can also include anti-bacterial and anti-microbial agents coated on or embedded in the material of the vent spanners.

Another system for raising pads to enable drying and air flow is a pad prop device. A pad prop creates an air gap between a pad and vent when placed against a key mechanism (other than a key touch), or a key mechanism and a musical instrument body. The pad prop's structure is designed to maintain sufficient mechanical friction and remain fixed when positioned to prevent the pad from sealing the vent and to increase air flow around the pad and body. Such designs include various longitudinally tapered and curved pad prop, a wedge-shape pad prop, a crutch-shaped pad prop, an L-shaped pad prop, a wedge-shaped device linked to a body tenon, end piece or other part of the instrument, etc. Pad props can have raised or depressed texturing to increase contact friction, a recessed neck and button top, and cavities and/or inner hollow areas for storage.

A linkage feature can connect one or more vent spanners and/or pad props. The linkage feature can be a string, strap, a cord, a chain, a beaded cord, or rigid member, such as a rod. The linkage feature can also assist in device storage. For example, a strap can have holes to accommodate a pad prop with a button, or the linkage feature can connect directly to the body of an instrument or to an end piece, such as an end cap, end plug, or tenon cap that can hold the devices and/or attach to the instrument. Linkage features, vent spanners and pad props can each individually or collectively include textured surfaces, anti-bacterial, anti/microbial and/or contain dehumidifying and other agents. Another variation is a flat finger tab that links one or more vent spanners.

DETAILED DESCRIPTION OF ILLUSTRATIVE EMBODIMENTS

Figure 1:
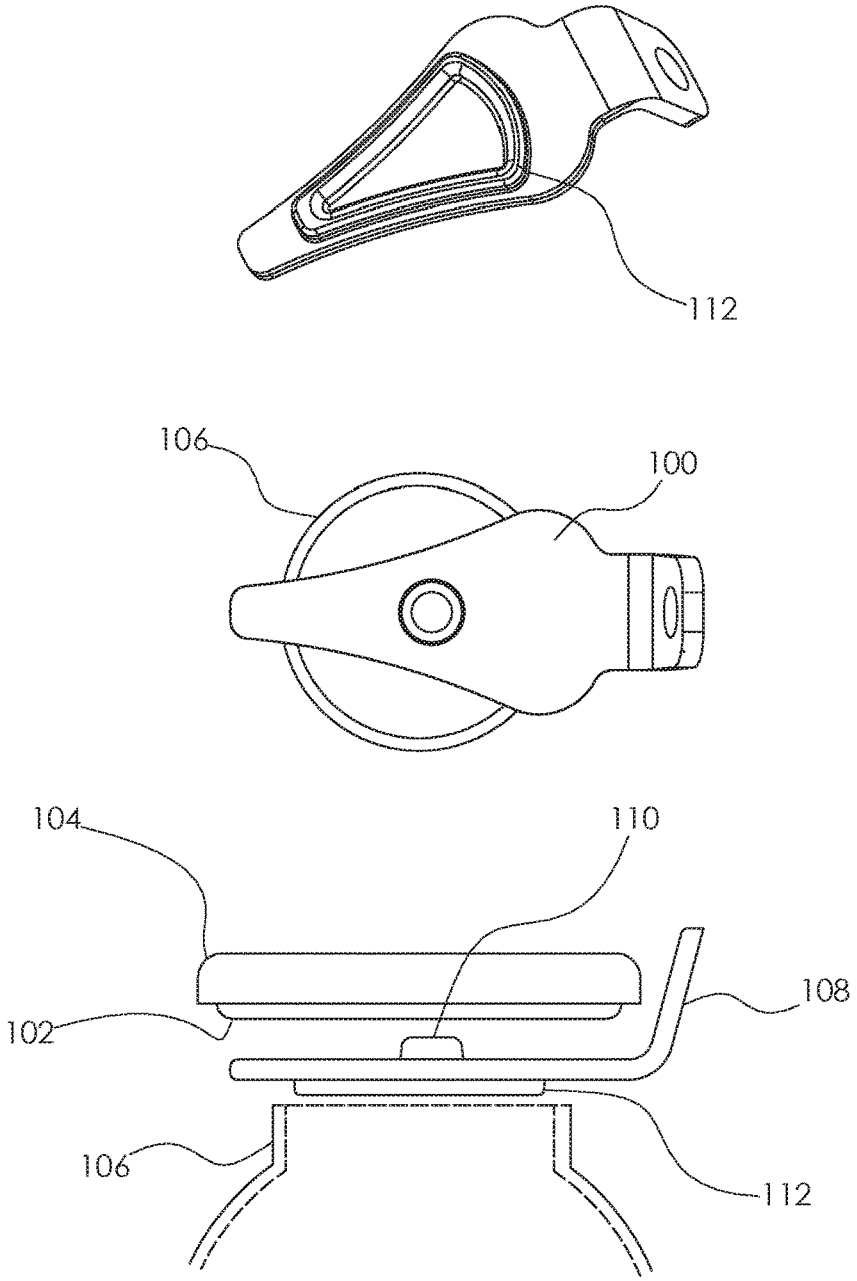
FIG. 1 illustrates a vent spanner in multiple angles.

TERMS: Various terms used in the present disclosure are described as follow, although such terms may have other descriptions included in the present disclosure or may otherwise be described in the art. Terms not listed here may also have meanings described in the present disclosure or may otherwise be described in the art.

"Body" includes any part of the musical instrument used for the generation of sound, or the surface along which, or through which, the sound resonates and/or travels. The body includes the structure through which the forced air and/or sound vibrations flow. The body may include, for example, the mouthpiece, the neck, the body tube, the valves, the vents, the bell, the bow, the tenon, etc. For example, if the musical instrument is a saxophone, the body of the instrument includes the reed, neck, body tube, vents, bow and bell.

"Key Mechanism" includes the key cup and all other pieces that form part of the musical instrument, aside from the body, the key touches and the pads, which are controlled by or facilitate control by the key touches. Key mechanisms generally couple the key touches to the key cups to facilitate the opening and/or closing of pads over vents, but supporting and ancillary devices are also included in the definition of key mechanism. For example if the musical instrument is a saxophone, the key mechanism would include all ribs, posts, rods, arms, key tabs, springs, key cups, bumpers, guards, feet, levers, auxiliary levers, rests, a lyre holder, connected to any other part of the key mechanism, etc.

"Key Touch" includes the portion of a musical instrument that is commonly illustrated in student fingering charts that a musician would touch with their fingers in order to perform a scale and to operate the instrument.

"Key Cup" includes the portion of the key mechanism that holds the pad.

"Key Arm" includes a portion of the key mechanism connected to a key cup or directly to a pad, including, but not limited to a lever.

"End Piece" includes a device auxiliary to the musical instrument that attaches to the musical instrument. This includes, but is not limited to, a plug, cap, end cap, end plug, tenon cap, mute, bell clips, clamps or fasteners to the body, anything interacting with a lyre holder, a removable lyre holder attached to the body or key mechanism, or inserts that interact with a mortis, tenon or bell of the body, etc.

"Musical Instrument" includes any woodwind, brasswind, pipe instrument, or any other instrument that employs vents and pads to control the flow of gas or liquid through the instrument.

"Pad" includes any material intended to seal the vent of a musical instrument other than the key cup. This may include, but is not limited to, pads made of leather, felt, cork, gut skin, synthetic rubbers, fabrics, metal, plastic, etc.

"Vent" includes any opening of a musical instrument that can be sealed by a pad to control the flow of gas or liquid through that opening.

"Seat" includes the area of a pad that directly contacts the vent surface.

"Resonator" includes any material mounted to the surface of a pad or the surface of a key cup (surrounded by a pad) facing a vent, regardless of whether the material exhibits resonant behavior, and is typically centered relative to the pad. This may include, but is not limited to, rivets, plates, washers, fasteners for open-hole (French) flute pads, pad mounting hardware such as pad snaps and nuts, etc.

The present disclosure includes cost effective devices and methods for keeping vents open and enabling pads to dry away from vents, thereby reducing pad rot and stick and malfunctions of the musical instrument. The present disclosure includes various embodiments of vent spanners, various embodiments of pad props, and various embodiments for joining one or more of these devices via a linkage feature.

TEST RESULTS: A non-public, confidential test was performed on two identical Selmer "Liberty" model alto saxophones over a 129 day period, where vent spanners, pad props and linkage features were used on one saxophone and not the other. Both saxophones had identical cases and were bought from the same product lot on the same day. Both saxophones were unpacked and checked for proper mechanical function. Both saxophones were used by a professional teaching musician during private practice and instruction of students, in either case without exposing the public to any aspects of the present disclosure. The saxophone not used with vent spanners, pad props and linkage features was labeled "Sax A" and the saxophone used with vent spanners, pad props and linkage features was labeled "Sax B." Sax A and Sax B were used alternately during each playing session, during which a smartphone was used to log usage date, play duration, and mechanical performance. Over the 129 day test period, Sax A was used for a total of 76.2 hours and Sax B for a total of 77.2 hours.

After each playing session with Sax A, Sax A was put into its case with a factory supplied end plug and stored until next use. After each playing session with Sax B, pad props, vent spanners and linkage features were used on Sax B prior to storage in its case until next use. Sax B pad props were used to open the pads of the low D-sharp, low C-sharp and G-sharp keys. Sax B vent spanners, connected via a linkage feature connected to an end plug, were used to open the pads of high D, high D-sharp, high E, high F and high F-sharp keys. Both saxophones were stored at room temperature in the same storage room when not in use. When stored, the cases for each saxophone were both placed in one of four resting positions: case hinge down, case bottom down, case top down, and left side down. Table 1 includes the results of mechanical performance during the course of the 129 day trial:

TABLE 1

| | Incidents of malfunction during play due to sticky pads: |
|---|---|
| SAX A: | 51 |
| SAX B: | 0 |
| | **Incidents of pad needing to be "unstuck" from vents immediately after storage** |
| SAX A: | 126 |
| SAX B: | 1 |

Vent Spanners

A vent spanner is a device that can be placed between a vent and a pad so as to create an air gap between the pad and vent that prevents the pad from sealing the vent and increases air flow around the pad and body. The increased airflow around the pad and vent helps them to dry after being played and reduces pad rot, sticky buildup and mechanical malfunction, either immediately after storage or during play, as illustrated in TABLE 1. An embodiment of a vent spanner is illustrated in FIG. 1, shown in perspective view from the bottom, top view over a vent, and side view between a vent and pad. The vent spanner illustrated in the top view includes a vent spanner section 100 configured with opposing first and second surfaces and rigidity sufficient to oppose the force of the pad 102 and key cup 104 closing onto the vent 106, as shown in the side view. Vent spanner section 100 is wedge or teardrop shaped, but may also be bar shaped or any other appropriate shape.

The vent spanner may also be a rigid mesh or grid, such as a series of very thin crisscrossed bar shaped sections or crisscrossed wires that are bent in such a way as to separate the pad from the vent and allow airflow around the body and pad. In an embodiment, the vent spanner section 100 spans the width of the vent 106 and contacts substantially diametrically opposed regions of the vent 106, although such contact is not required as long as the vent spanner will remain in substantially the same position once it has been properly placed. Hence, a vent spanner may be attached to one side of a vent, such as through a clip or other mechanical connection, adhesive or other fastening means, and still prevent the pad from sealing the vent and allow for increased air flow. The vent spanner may also include a handle 108 to ease placement and removal, as well as to facilitate linkage as further described herein, and a positioning feature, such as the protuberance 110 on the first or upper surface as further described below. As illustrated by the side view and the perspective view of FIG. 1, the vent spanner section 100 may also include a retention feature 112, which ensures that the vent spanner will remain in a substantially secured and/or centered position relative to the vent opening.

Figure 2:
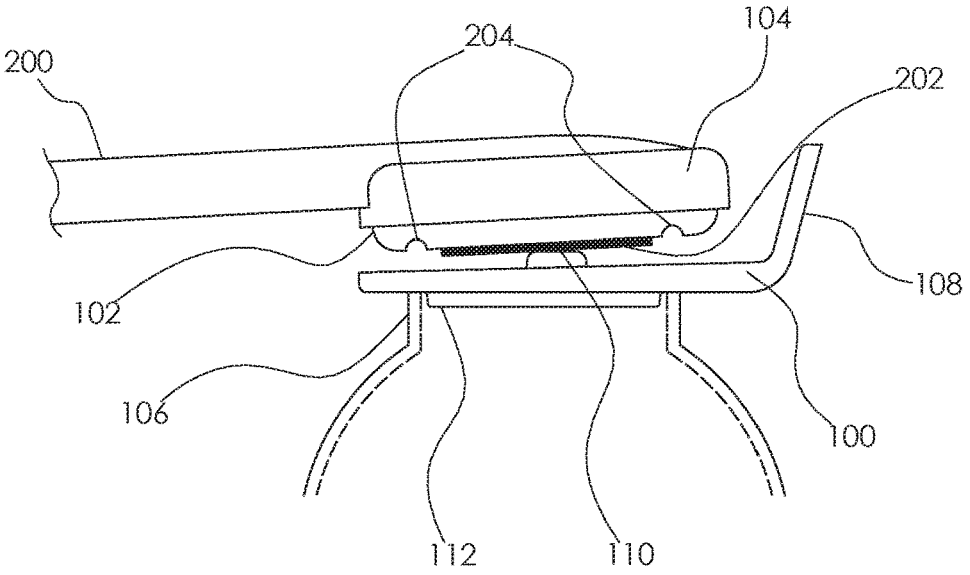
FIG. 2 illustrates a vent spanner with a sloped vent spanner section.

Some pads 102 include a resonator 202, as illustrated from the side view of a vent spanner in FIG. 2, the height of the vent spanner section 100 may be sloped. The angle of inclination of the vent spanner section 100 accounts for an angle of the raised key arm 200 relative to the vent 106, and allows for a more optimal contact between the protuberance 110 and the resonator 202 by increasing airflow and/or preventing the seat 204 of the pad from contacting the vent spanner.

Figure 3:
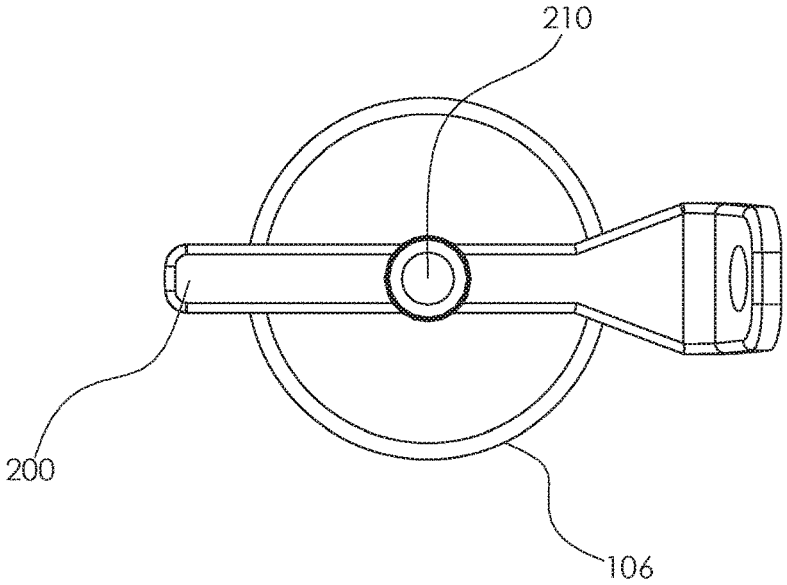
FIG. 3 illustrates the top view of a vent spanner with a minimalist design.
Figure 4:
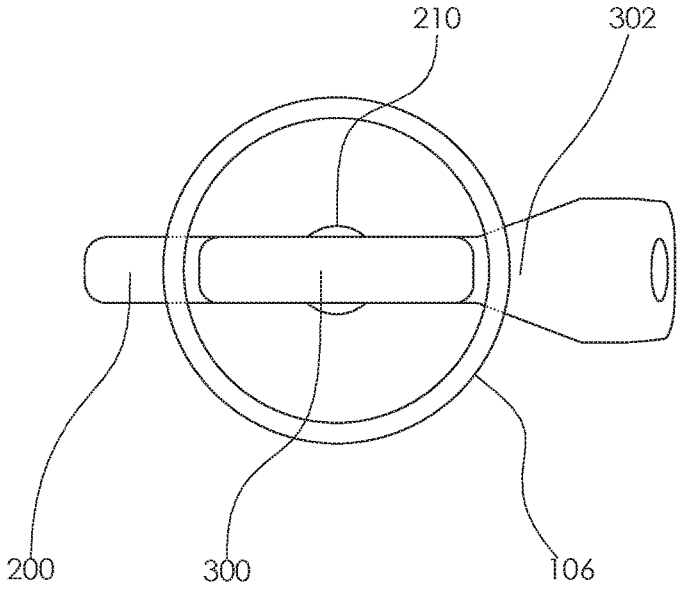
FIG. 4 illustrates the bottom view of a vent spanner with a minimalist design.

In one example, the protuberance 110 is located on the first surface of the vent spanner section. This centering feature also assists in creating a greater air gap between the pad and the vent for air flow and drying purposes, with or without a resonator (although ideally, the protuberance should not be in direct contact with the pad so as to enable the entire pad to dry). As illustrated in the top view of FIG. 3, the protuberance 210 is positioned in an area of the vent spanner section 200 that will be proximate a central area of the vent 106. FIG. 4 illustrates a bottom view of the vent spanner section 200 with a retention feature 300 added to the bottom of the vent spanner section 200. The retention feature 300 helps secure the vent spanner section 200 within the vent 106 opening and secures the vent spanner section 200 in position. Stability may be added to the vent spanner section 200 through use of the retention feature 300's width, friction at touch points of the vent 106 side walls, or mechanical or magnetic features that connect or hold the vent spanner section 200 to either the vent 106 walls, the pad or the resonator. As shown in FIG. 4, one end 302 of the vent spanner section 200 is wider near the handle 304 to provide stability to the vent spanner section 200.

Figure 30:
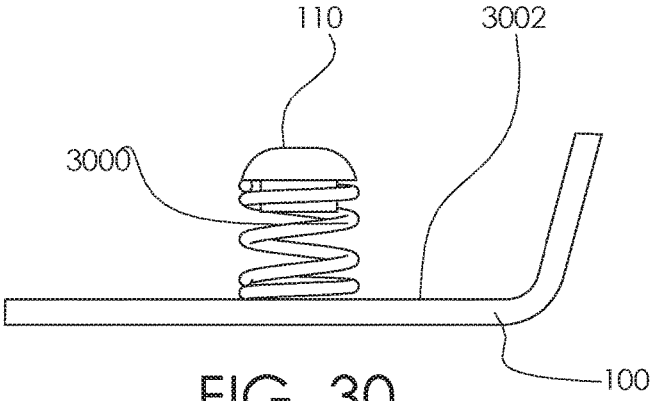
FIG. 30 illustrates a spring top positioning feature and retention feature.
Figure 31:
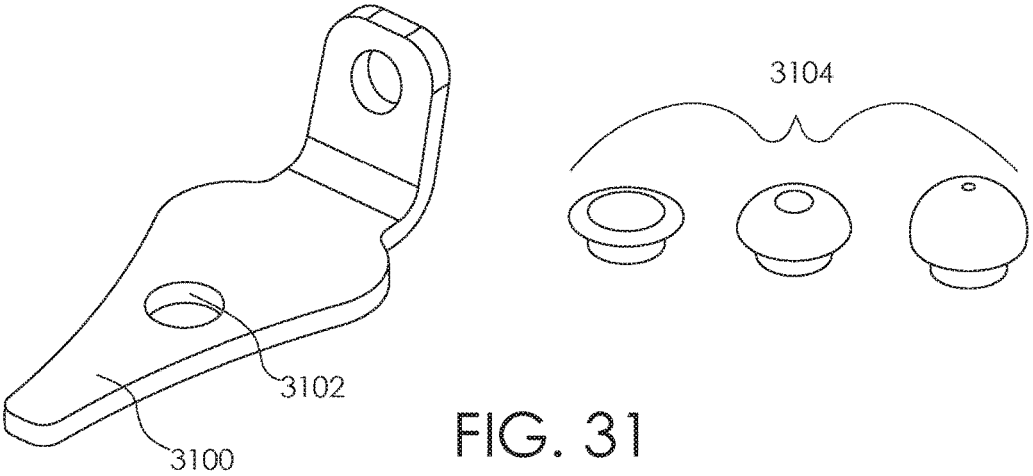
FIG. 31 illustrates variations of interchangeable positioning features.
Figure 32:
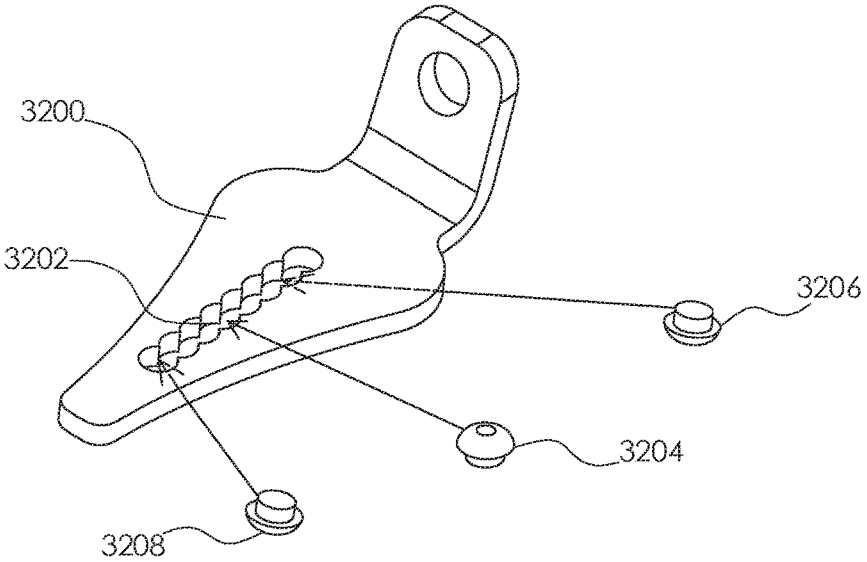
FIG. 32 illustrates a vent spanner with customizable positioning for interchangeable positioning features and interchangeable retention features.

In an embodiment, illustrated in FIG. 30, a spring 3000 is included under the protuberance 110. The spring 3000 is attached on one end to the top surface 3002 of the vent spanner section 100 and attached on a second end to the protuberance 110. Protuberances 110 can be variably sized, as well as interchangeable and customizable. FIG. 31 illustrates an example of an interchangeable protuberance that can be placed onto a vent spanner section 3100 equipped with an opening 3102 though which various protuberances 3104 can be snap fit or screwed or adhered into place. A threaded hole 3102 and protuberance 3104 may allow for a customizable height adjustment of the protuberance to be carried out by a user. Additionally, the position of the protuberance can be adjusted. FIG. 32 illustrates one embodiment wherein the vent spanner section 3200 includes a central cutout or opening 3202 that allows a protuberance 3204 to be placed at various positions within the opening 3202. Limiters 3206 and 3208 may be placed in the opening 3202 on the second or bottom surface (or alternatively on the first or top surface) of the vent spanner section 3200 to limit travel of the protuberance 3204 within the opening 3202. The limiters 3206 and 3208 may also be used as the retention and/or placement feature for the vent spanner section 3200. This customizable system may be ideal for musical instruments with larger vents, such as a baritone saxophone.

Figure 33A:
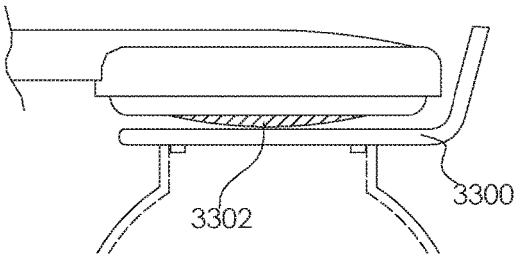
FIGS. 33A and 33B illustrate vent spanner embodiments having one or more of a positioning feature and a retention feature engaging with a resonator.
Figure 33B:
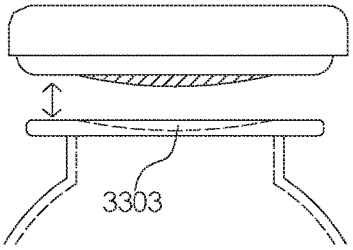

In an alternative embodiment, illustrated in FIG. 33A, the vent spanner section 3300 does not have a top protuberance. When an instrument's resonator 3302 protrudes in a manner sufficient to create an air gap between the pad and vent when contacting the vent spanner, a top protuberance is not necessary, although some form of centering feature, such as a visual indicator may be desirable so a user knows where best to position the vent spanner. FIG. 33B shows an alternative embodiment with depressions of the vent spanner section 3303 used to couple with resonator material, acting as both a positioning feature and a retention feature.

Figure 10:
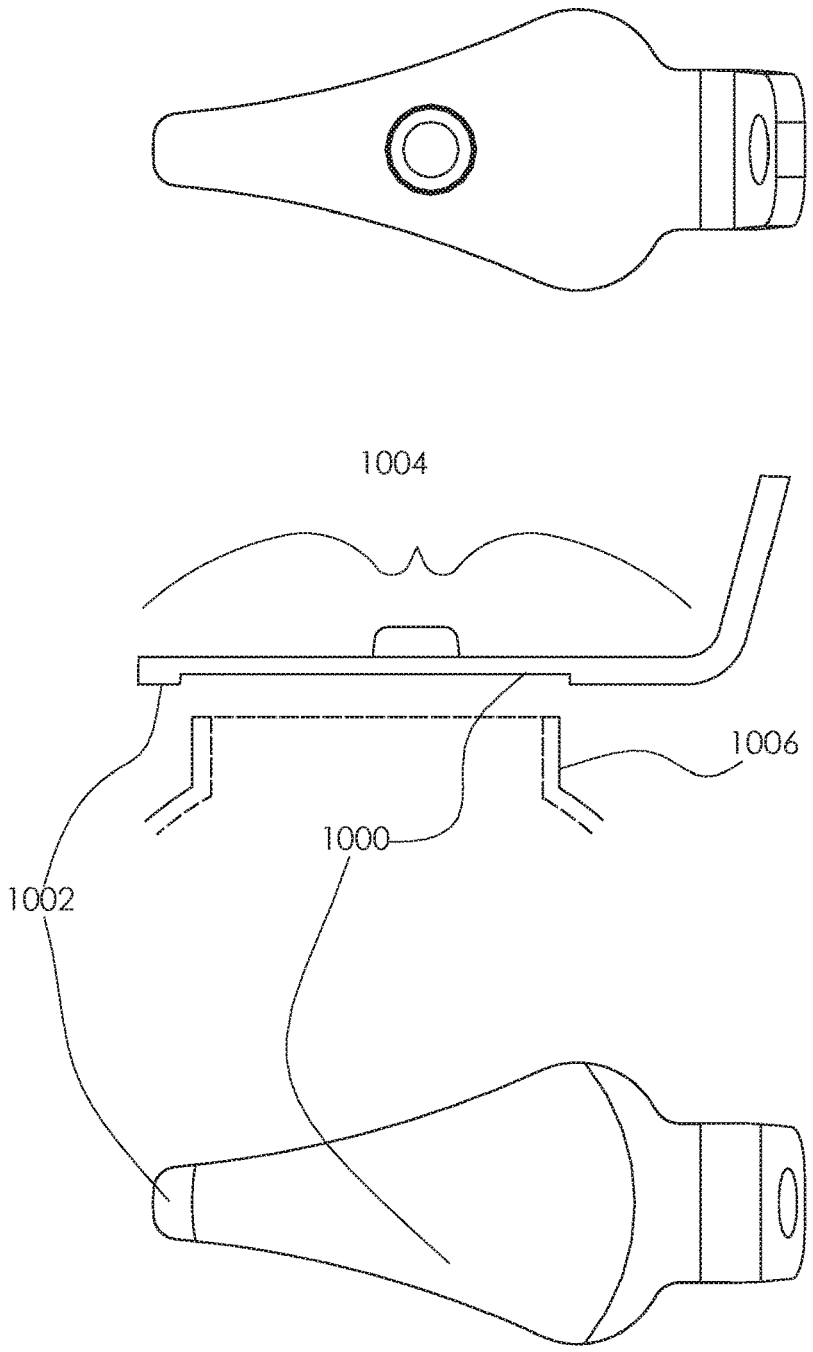
FIG. 10 illustrates a vent spanner with a positioning feature and a retention feature with depressions surrounding the vent opening.

Other examples of the retention feature located on the second or bottom surface of the vent spanner section is shown in FIGS. 6-10, at least. A retention feature includes one or more raised surfaces and/or depressions that act as mechanical stop bumpers against the vent (see details in FIG. 8-10) to at least help to secure the vent spanner against the vent. The raised surfaces and/or depressions can be positioned on the inside of the vent wall (FIG. 8), the outside of the vent wall (FIG. 9), or on both sides, such as a combination of the retention features illustrated in FIGS. 8 and 9. FIG. 10 illustrates a retention feature 1000 created by a depression formed in the bottom surface 1002 of the vent spanner section 1004, which depression is slightly larger than the vent 1006. The retention feature allows the vent spanner to accommodate vents and tone hole spaces of various shapes, sizes, and circumferences. A retention feature can also engage with the resonator material as shown in FIG. 33B.

Figure 34A:
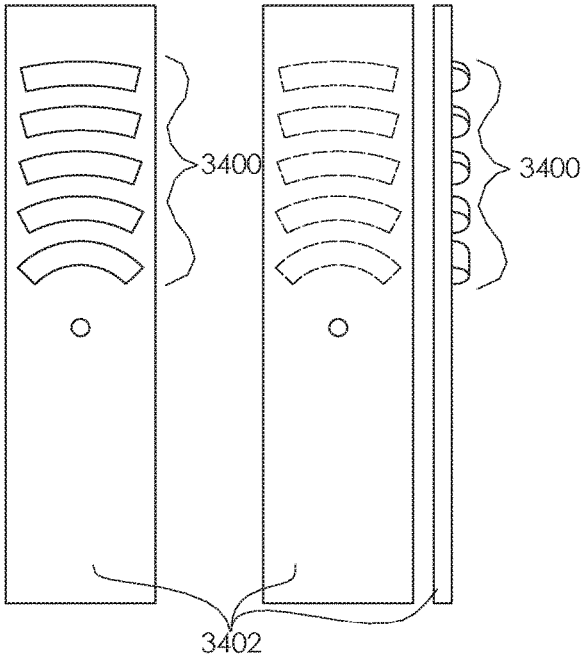
FIGS. 34A and 34B illustrate two designs for positioning and retention of a vent spanner.
Figure 34B:
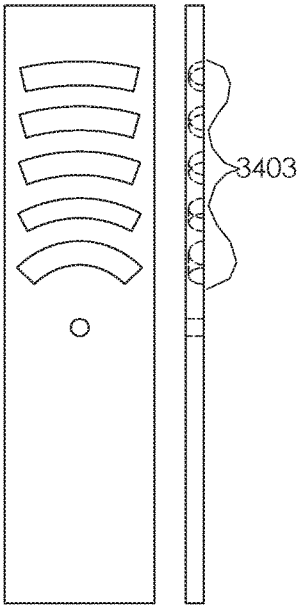

Designs for a retention feature include a plurality of concentric protuberances 3400 such as circular raised ribs that expand upon the length of the vent spanner section 3402, such as illustrated in FIG. 34A. Concentric depressions 3403 may also be used as a retention feature, such as illustrated in FIG. 34B. A retention feature is configured to engage the vent or resonator material and thereby prevent the vent spanner from slipping off the vent or slipping toward the delicate pad seat when a vent spanner is placed between a pad and a vent, as shown in FIGS. 1-2, 4, 6-13 and 25, 32, 33, 35. While a retention feature may also be configured to help position the protuberance located on the first surface of the vent spanner section so that the protuberance is against the pad or resonator but not in contact with the delicate seat area 204 of the pad 102 as shown in FIG. 2, the protuberance also acts as a position feature, visually indicating to the user where the vent spanner should be positioned so as to ensure the pad stays open and air flow is increased. In another example, FIG. 2 shows a vent spanner has a handle 108 to make it easier to grasp with human fingers and position on the instrument. A handle may also serve as a connection point for a linkage feature as shown in FIGS. 5 and 25, 42 and 56.

Figure 11:
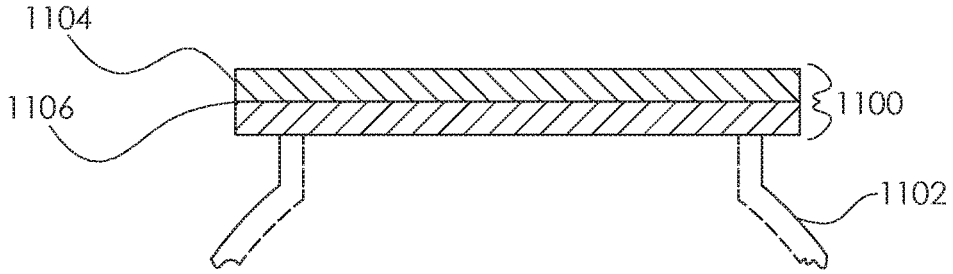
FIG. 11 illustrates a side cross-section view of a vent spanner positioned over a vent.

The side cross-section view of FIG. 11 illustrates an embodiment of a vent spanner 1100 positioned over vent 1102 that includes no protuberance and no mechanical feature extending from or into the vent spanner section to retain the vent spanner over the vent 1102. However, vent spanner 1100 may still include a positioning feature or a retention feature. For example, the positioning feature may be a visual indicator on the rigid first surface 1104, such a printed indicator of approximately the same size and position as the protuberance shown in FIG. 10, but without any three dimensional aspect. Likewise, the second surface 1106 may be formed of a flexible material that will engage the vent 1102 and serve to retain the vent spanner 1100 in position. Materials such as rubber, foam, certain tacky plastics, etc., may be suitable retention features. Second surface 1106 may also be rigid, but coated with a substance that will perform as a retention feature, such as an adhesive.

As noted, the first surface 1104 and the second surface 1106 may be formed of any rigid material, such as plastic, metal or even wood. Polypropylene or food grade, bisphenol A (BPA) free plastics may be used in an embodiment. If wood or other porous material is used, a coating or treatment may also be used to prevent moisture absorption. Plastic materials may also include one or more additives that include antimicrobial and/or antibacterial agents, such as 2/9 $AG_2O.(P_2O_5.ZnO)m.(2CaO.3B_2O_3)n$, which is sold under the brand name MILLION KILLER by Shanghai Wako Chemical Col., Ltd., of China, and which contains silver ion particles in a glass network structure that are slowly released over time and allow the plastic material to which they are added retain an antimicrobial effect for an extended period of time.

Figure 12A:
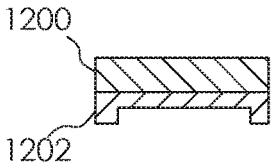
FIGS. 12A-12E illustrate end cross-section view of embodiments of vent spanners having different position features and retention features.
Figure 12B:
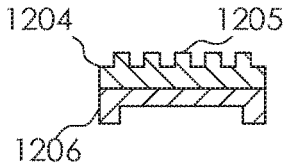
Figure 12C:
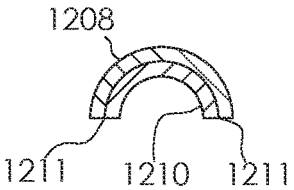
Figure 12D:
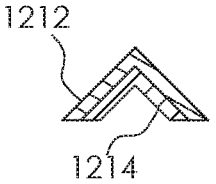
Figure 12E:
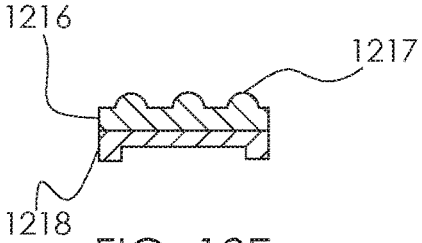

The end cross-section views of FIGS. 12A-12E illustrate various additional embodiments of vent spanners with different positioning features and retention features. For example, in FIG. 12A, the first surface 1200 may be the same as first surface 1104, but the second surface 1202 may include a depressed area in one or more locations as a retention feature, with or without additional retention features already described, such as a retention coating. In FIG. 12B, the first surface 1204 may include a number of raised areas, such as ridges or channels 1205, that run along all or part of the length as positioning features and second surface 1206 includes a retention feature similar to that of FIG. 12A. In FIG. 12C, the vent spanner is semi-circular or upside down U-shaped, such that the first surface 1208 forms an outward curved surface and second surface 1210 forms an inward curved surface. The top of the first curved surface 1208 may run all or part of the length of the vent spanner and server to act as a positioning feature. The legs 1211 formed by the ends of the first surface 1208 and the second surface 1210 may then sit on the vent, such as vent 1102 of FIG. 11, and serve as retention features. Similarly, the upside down V-shape of the vent spanner in FIG. 12D may operate in a similar manner, with first surface 1212 including an apex that runs down part or all of the length of the vent spanner and serves to position the vent spanner over the vent, and the legs formed by the ends of the first surface 1212 and the second surface 1214 operate as retention features over the vent. FIG. 12E illustrated yet another embodiment where the first surface 1216 includes a plurality of raised mounds, bumps, squares, etc. 1217 and the second surface 1218 is similar to second surfaces 1202 and 1206 of FIGS. 12A and 12B, respectively.

Figure 5:
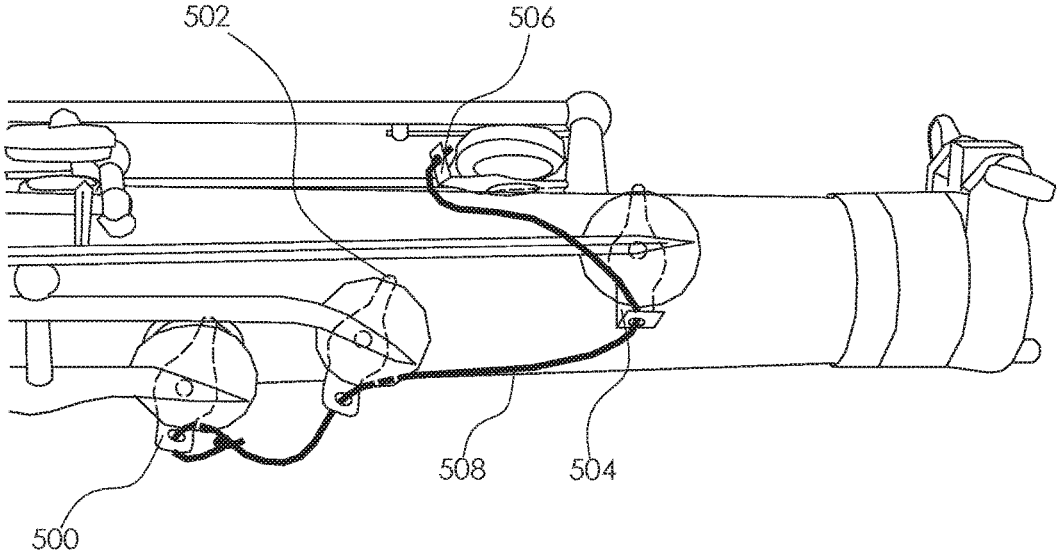
FIG. 5 illustrates vent spanners with a linkage feature applied to a tenor saxophone.
Figure 6:
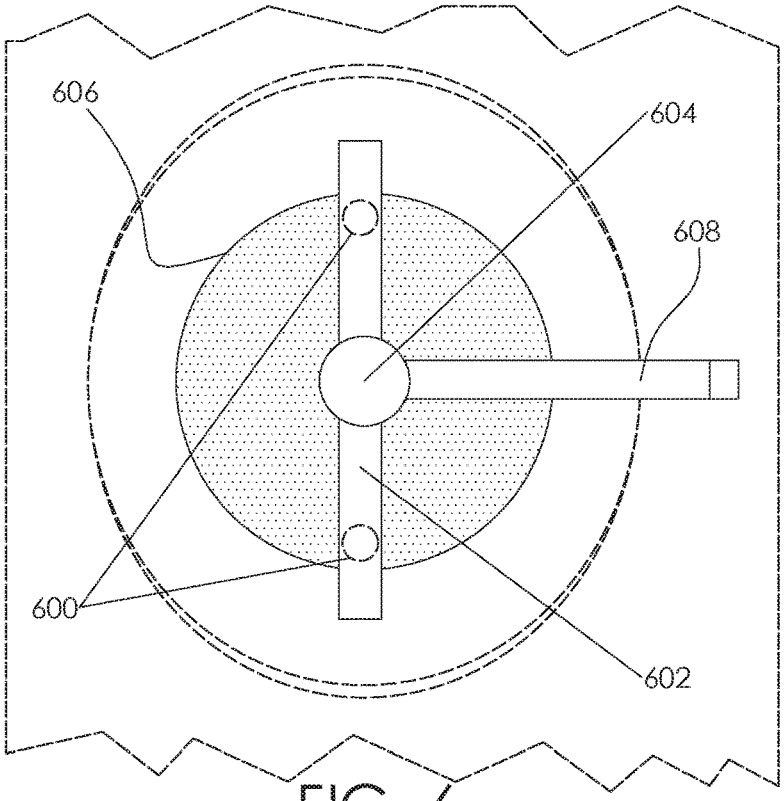
FIG. 6 illustrates a top view of a vent spanner applied to a clarinet vent.
Figure 7:
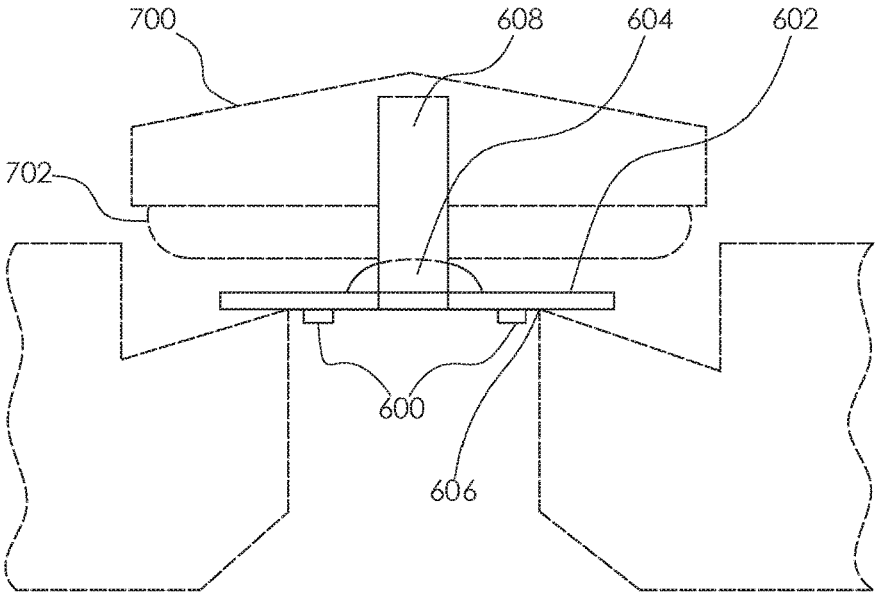
FIG. 7 illustrates a side view of a vent spanner applied to a clarinet vent.
Figure 8:
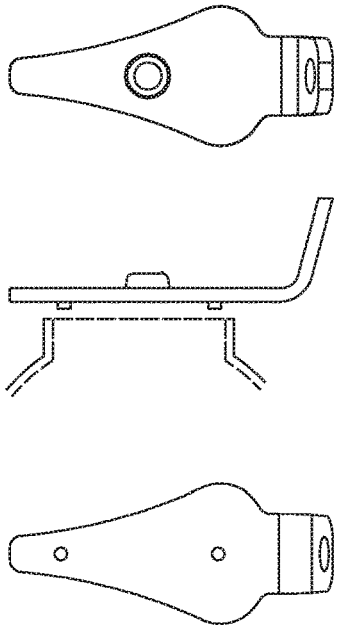
FIG. 8 illustrates a vent spanner with a positioning feature and a retention feature with raised surfaces positioned inside the vent wall.
Figure 9:
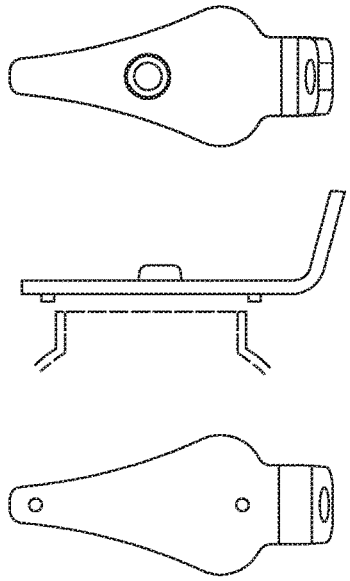
FIG. 9 illustrates a vent spanner with a positioning feature and a retention feature with raised surfaces positioned outside the vent wall.
Figure 13:
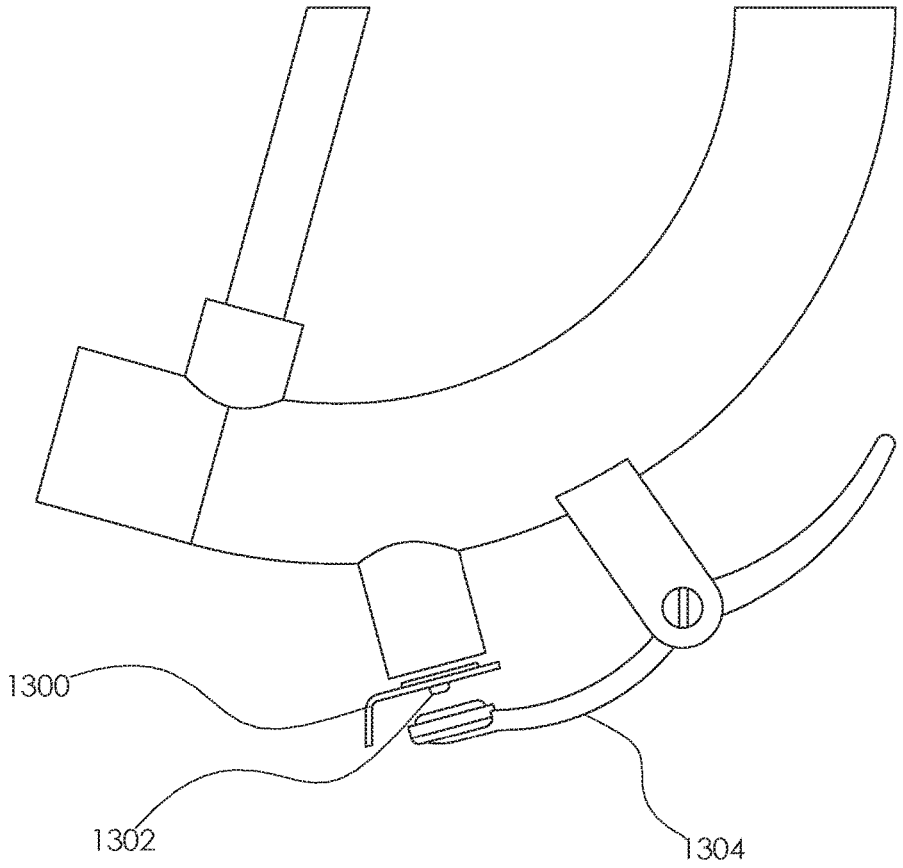
FIG. 13 illustrates a vent spanner applied to a brasswind water key.

Vent spanners can be designed to fit multiple instruments, keys, vent sizes, and orientations. FIG. 5 illustrates vent spanners 500, 502, 504 and 506 with a linkage feature 508 (further described below) applied to a tenor saxophone. In this example, vent spanners are placed between the pads and vents for the high D, high D-sharp, high E, and high F keys, and connected through a cord (linkage feature 508) passing through the handle of each vent spanner 500, 502, 504 and 506. FIGS. 6 and 7 show a vent spanner with a handle, applied to a clarinet tone hole vent. The retention feature 600 keeps the vent spanner section 602 in position over the vent 606 and the protuberance 604 centered under the pad 702 to allow air flow but avoid contacting the delicate pad seat. The key cup 700 and pad 702 are shown as dashed lines in FIG. 7 (as is the remainder of the clarinet body), around the vent 606. The handle 608 may attach to any point along a vent spanner section 602. FIG. 13 shows an example of a vent spanner 1300 with a large protuberance 1302 opening a brasswind water key 1304.

Vent Spanners can be made of any material that can span across a vent to hold the pad open with a greater upward force than the downward force of the pad.

Pad Props

Pad props also serve to hold open one or more pads over vents of musical instruments, but without getting between the pads and the vents like a vent spanner. With a pad prop, the shape of the pad prop is used as a type of wedge or similar structure that can be placed in-between key mechanisms or the key mechanism and the body to hold a pad open and create an air gap between one or more pads and vents for increased air flow. This increases air flow around the pad and vent, thereby allowing them to dry after being played and reducing pad rot, sticky buildup, bacterial and microbial development, body material degradation, and instrument malfunction. A pad prop is not a part, or component of, a musical instrument body, and can be made of any material or shape that would be sufficient to enable the pad prop to be placed against the key mechanism and/or body of a musical instrument, or both, with sufficient friction or mechanical hold necessary to hold one or more pads in a fixed open position.

Figure 14:
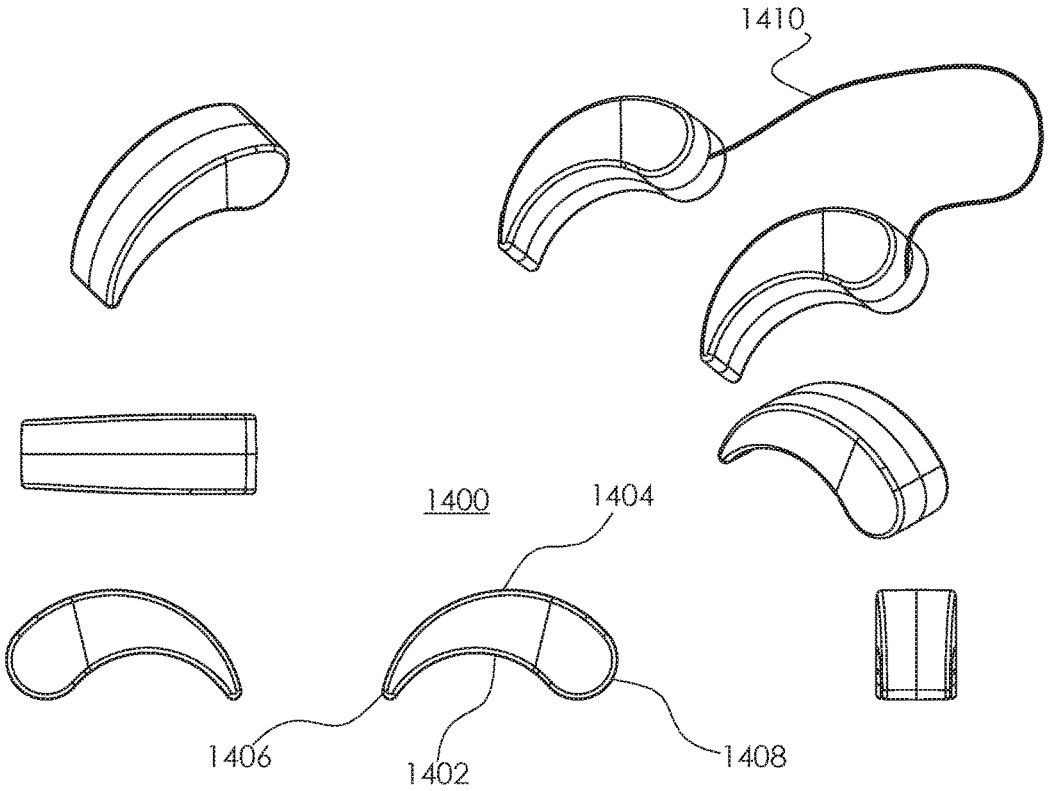
FIG. 14 illustrates numerous views of a pad prop design.

An embodiment of a pad prop is illustrated by the many different views in FIG. 14. In this embodiment, the pad prop 1400 is longitudinally tapered and curved for greater versatility. The shape of pad prop 1400, which includes a small radius 1402, a large radius 1404, a tip 1406 and a butt 1408, creates more surface area contact and improves friction and grip with the instrument (e.g., on the body tube, key posts, key cups, etc.). The contouring of the pad prop 1400 is complimentary to the various shapes and positions of key mechanism and/or the musical instrument body shape with which the pad props are used. The shape also allows the pad prop to fit in tight areas (e.g., between keys), prop up keys at multiple positions and heights, and lay flush against rounded key cups and body tubes. As is also illustrated in FIG. 14, a linkage feature 1410 can be attached to each pad prop 1400 in a variety of different ways, further discussed below, to keep all of the pad props for an instrument together and prevent pad props from being lost in the event one is dislodged.

Figure 15:
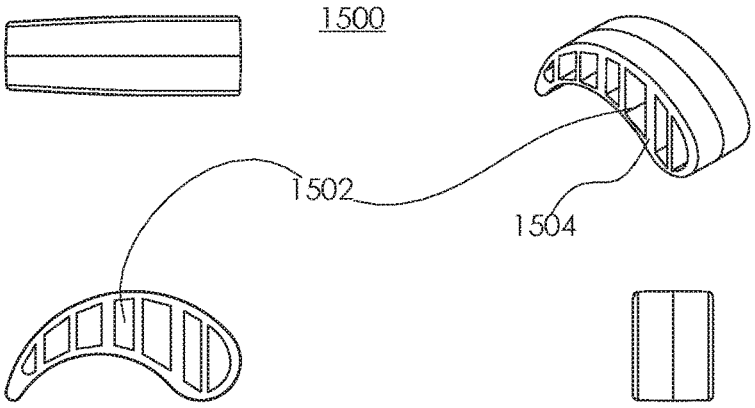
FIG. 15 illustrates top, side, and rear views of a pad prop design with hollow areas.

Another embodiment of a pad prop is illustrated in FIG. 15. Pad prop 1500 has substantially the same shape as pad prop 1400, but is not solid as is pad prop 1400. Rather, pad prop 1500 includes one or more hollow areas 1502 that are formed within the interior area 1504 of the pad prop 1500. One or more hollow areas 1502 help to create a spring-like flexibility and compressibility that may make it possible to fit the pad prop 1500 into areas of an instrument than would not otherwise be possible with a solid, less flexible design. Hollowed designs may also serve to decrease material and production expense. A pad prop may also have a surface friction sufficient to hold the pad prop in position against a key mechanism and/or an instrument body without slipping out of position, either right away or over time. In one embodiment, the pad prop may be made of compressible and/or flexible material so that the force of the key mechanism depresses into the pad prop thereby forming a stronger mechanical hold and helping the pad prop to remain in the intended position that keeps the pad raised. The hollow regions or areas 1502 of the pad prop 1500 shown in FIG. 15, for example, may serve to increase the compression and/or elastic effect of the pad prop 1500 while reducing material cost.

Figure 27:
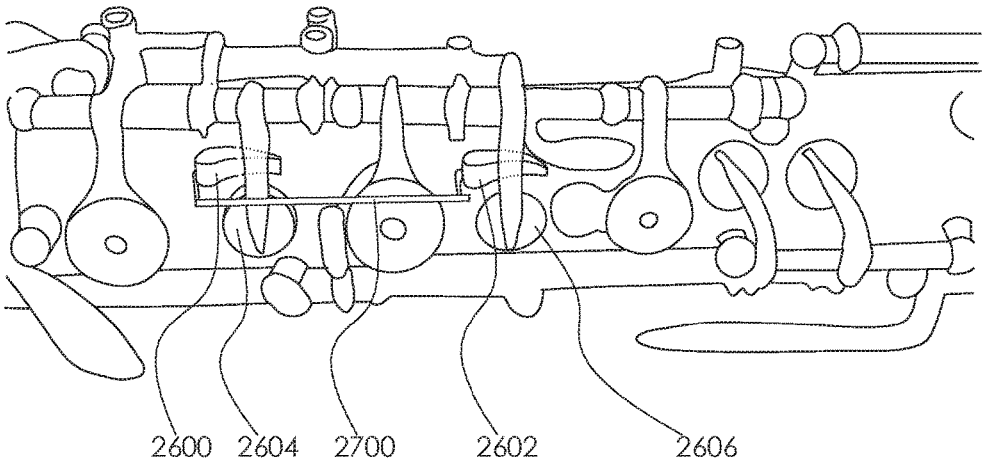
FIG. 27 illustrates pad props with a rigid linkage feature applied to an oboe.
Figure 28:
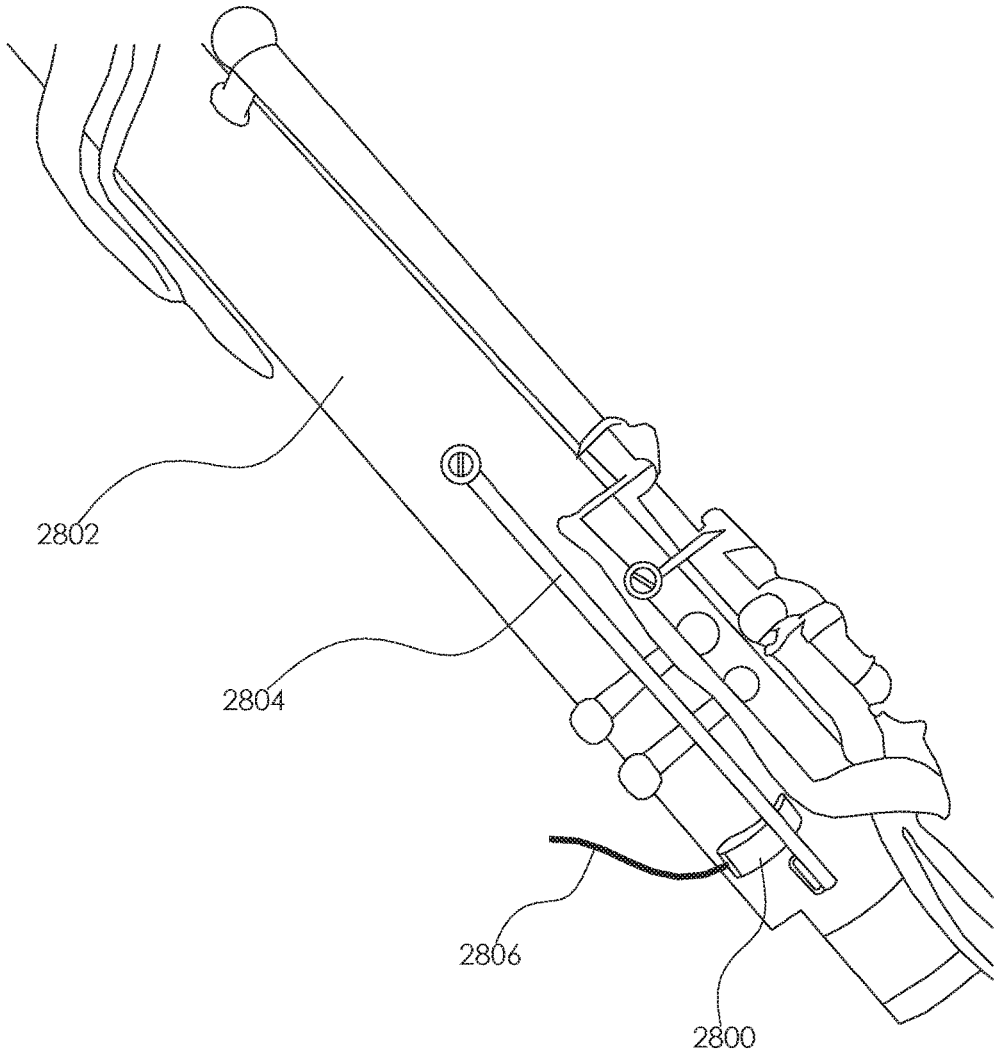
FIG. 28 illustrates a pad prop with a linkage feature applied to an oboe.
Figure 29:
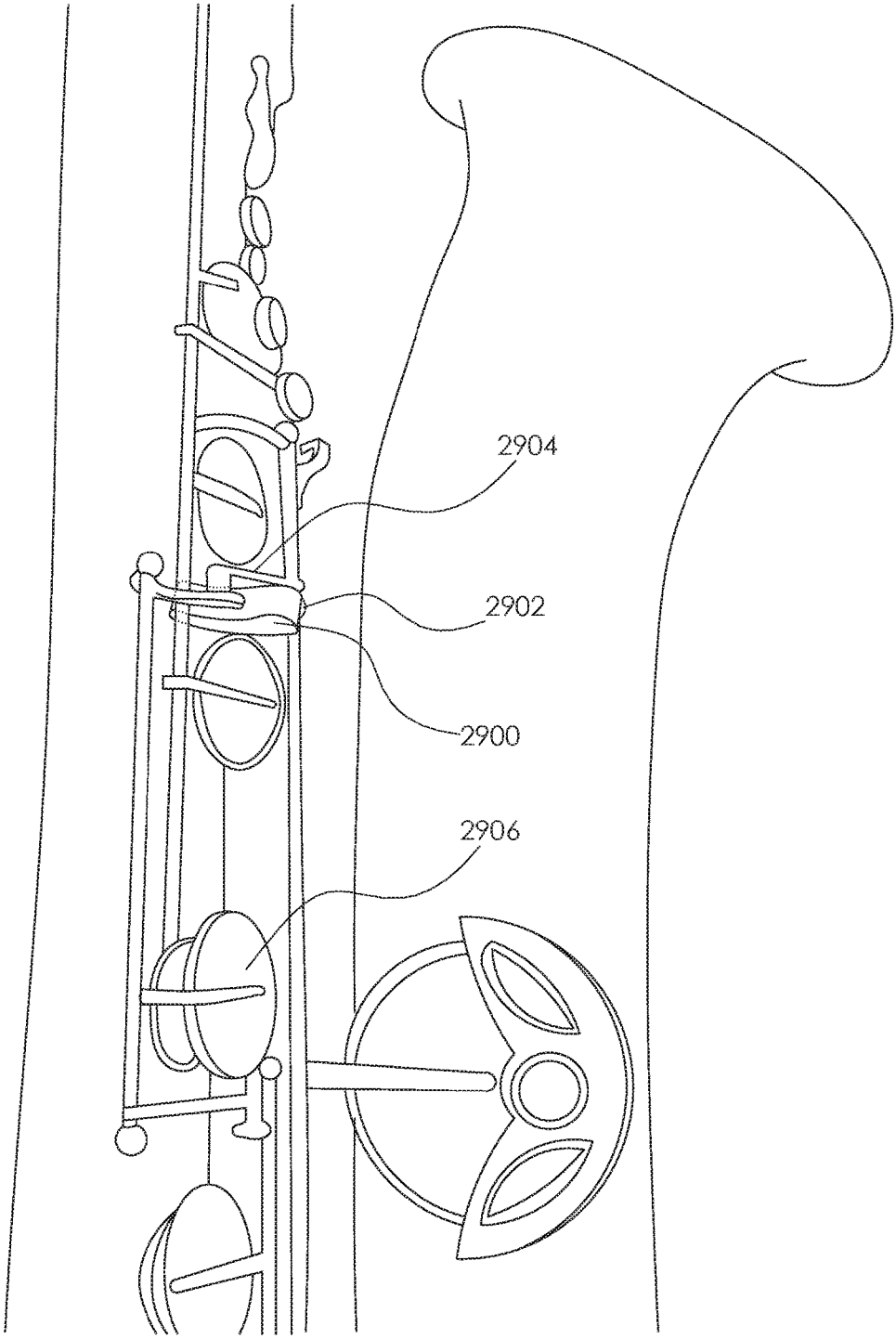
FIG. 29 illustrates positioning a pad prop against a key mechanism only.

Examples of different uses for pad props with different instruments are illustrated in FIGS. 16-29. In FIG. 29, for example, a pad prop 2900 is placed so that its large radius is against the G-sharp key post 2902 (which is shown below the pad prop 2900 in FIG. 29) of a baritone saxophone and the small radius of the pad prop 2900 is against the G-sharp auxiliary lever 2904 so as to allow the G-sharp key cup 2906 to open. As such, the pad prop 2900 is only touching different parts of the key mechanism and is not touching the body of the instrument. In contrast, FIG. 28 illustrates a pad prop 2800 being used on the top joint of an oboe by placing the small radius of the pad prop 2800 against the body of the oboe 2802 and the placing the large radius of the pad prop 2800 against a top joint auxiliary lever 2804 that opens the B-flat "vent key" and C "vent key" (both shown in FIG. 27 as 2604 and 2606 respectively). A linkage feature 2806 is also illustrated being connected to the butt of pad prop 2800 on one end, which linkage feature 2806 would be connected to something else (not shown) on its other end.

Figure 16:
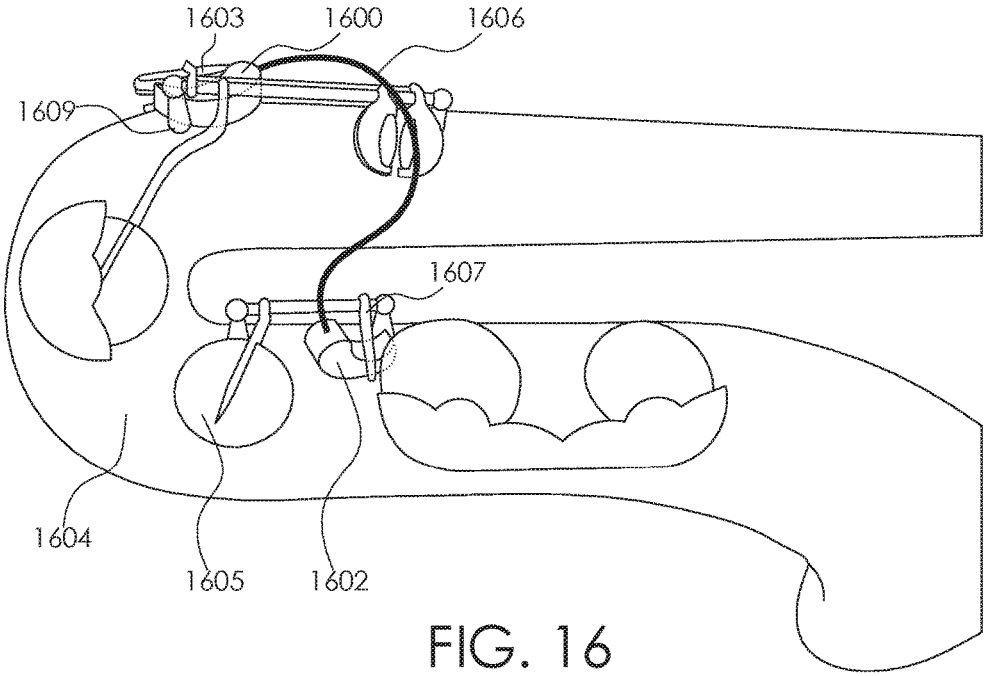
FIG. 16 illustrates pad props with a linkage feature applied to a tenor saxophone.

Pad props can be designed to fit multiple instruments, keys, vent sizes, and orientations. FIG. 16, for example, illustrates pad props 1602 and 1600 being used to raise the low D-sharp pad held by low D-sharp key cup 1603 and the low C-sharp pad held by low C-sharp key cup 1605, respectively, on a tenor saxophone 1604, and being linked together by linkage feature 1606. Pad prop 1602 has the curved side with the larger radius placed against the body of saxophone 1604 while the curved side with the smaller radius contacts the low C-sharp auxiliary lever 1607 to raise the corresponding pad from its vent. For the low D-sharp key, the pad prop 1600 is placed on its side against the saxophone 1604 with the smaller radius placed against the key cup 1603 and the larger radius in contact with the low D-sharp key post 1609. The thickness of pad prop 1600 is sufficient to raise the key arm and create a gap between the corresponding pad and vent. It is important to note that on modern saxophones, using a pad prop to raise the low C-sharp pad will also raise the G-sharp pad through related key mechanisms.

Figure 17:
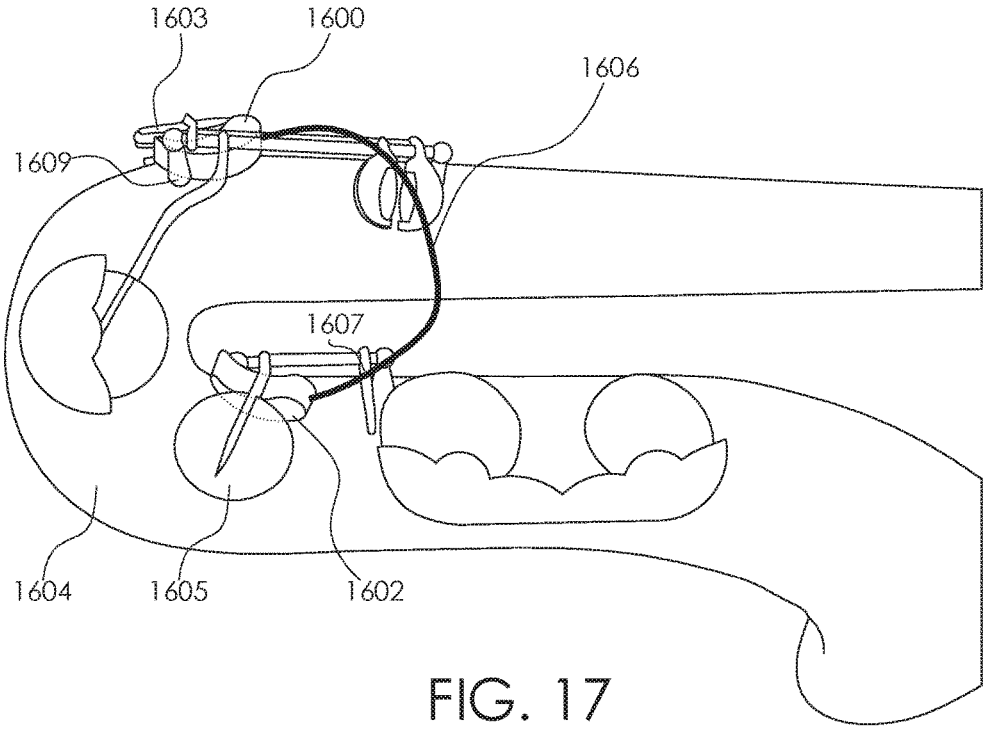
FIG. 17 illustrates alternate pad prop orientations on a tenor saxophone.
Figure 18:
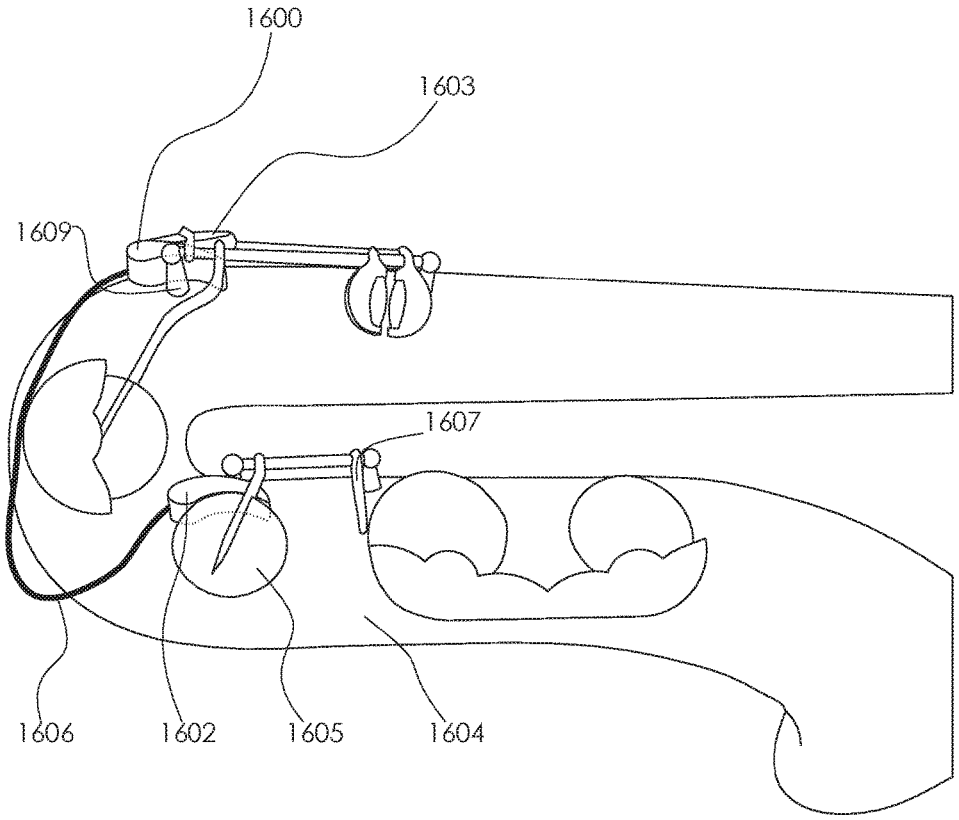
FIG. 18 illustrates another alternate pad props orientation on a tenor saxophone.
Figure 19:
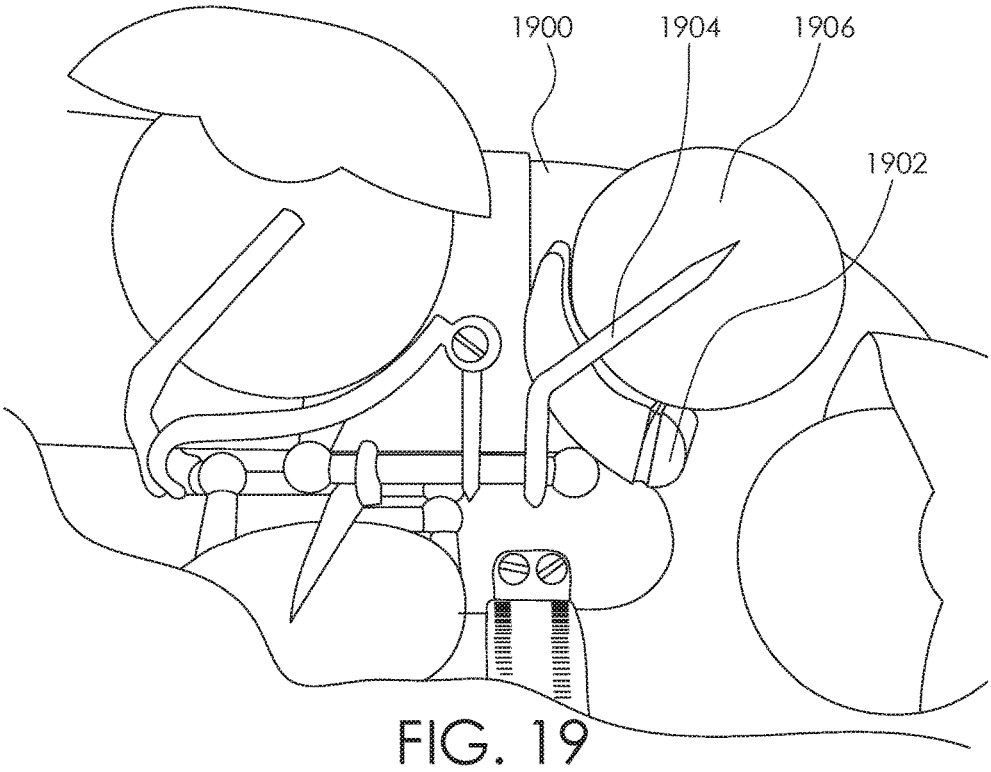
FIG. 19 illustrates a pad prop applied to the low C-sharp key of an alto saxophone.
Figure 20:
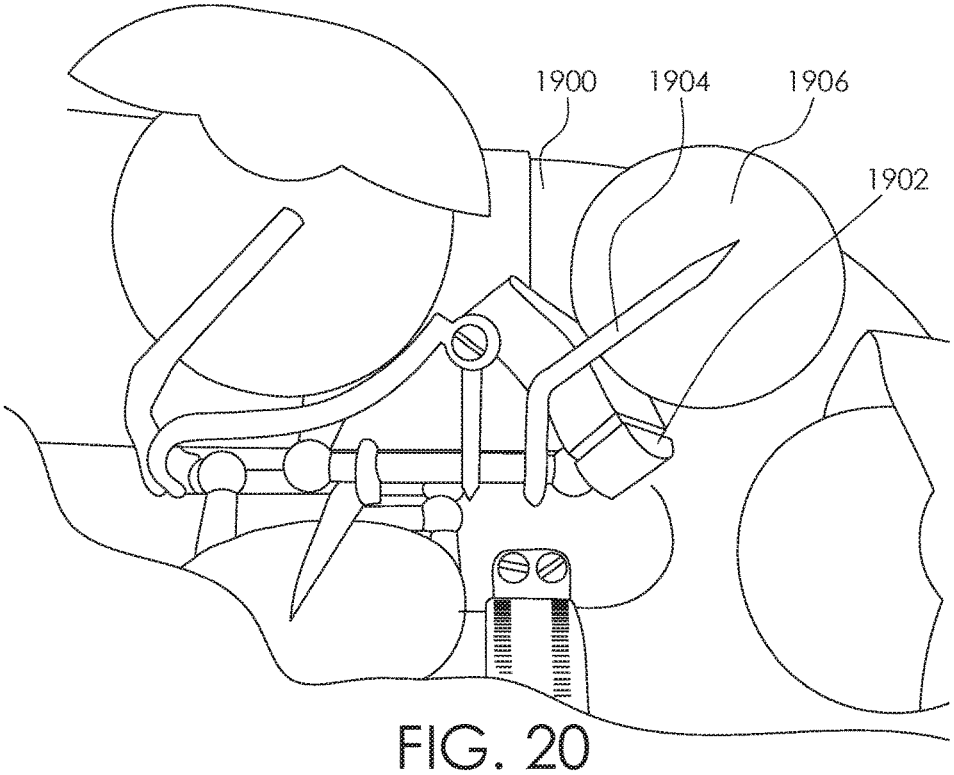
FIG. 20 illustrates an alternate pad prop orientation on the low C-sharp key of an alto saxophone.
Figure 21:
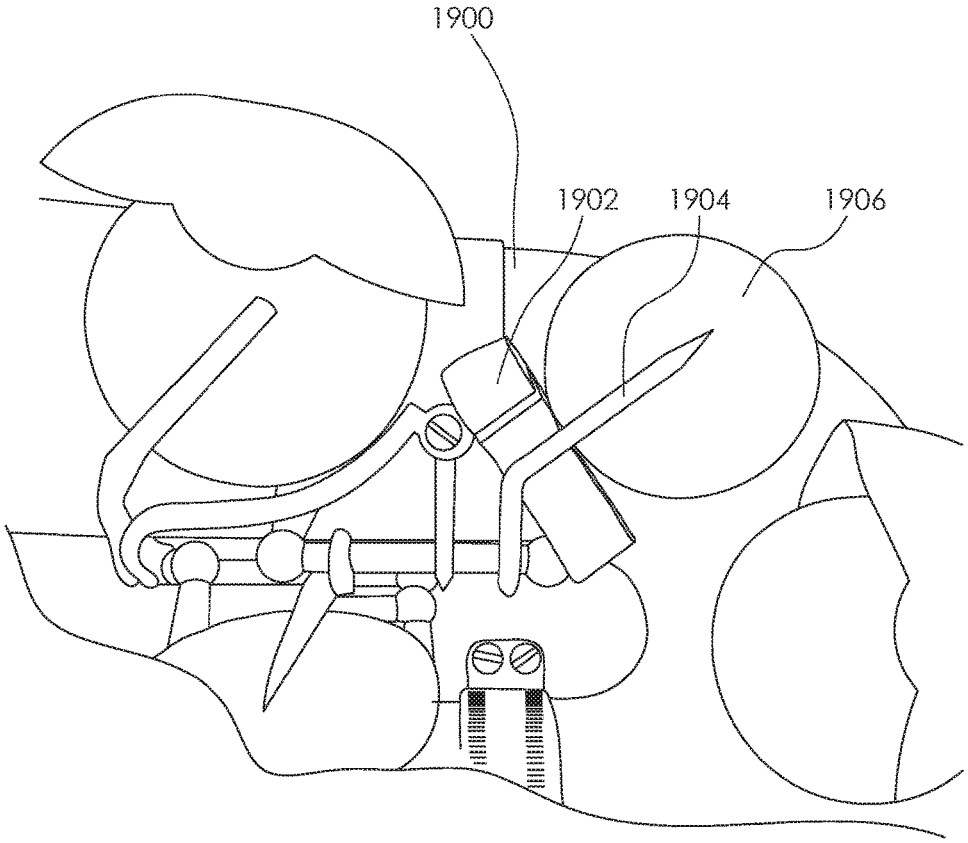
FIG. 21 illustrates another alternate pad prop orientation on the low C-sharp key of an alto saxophone.
Figure 22:
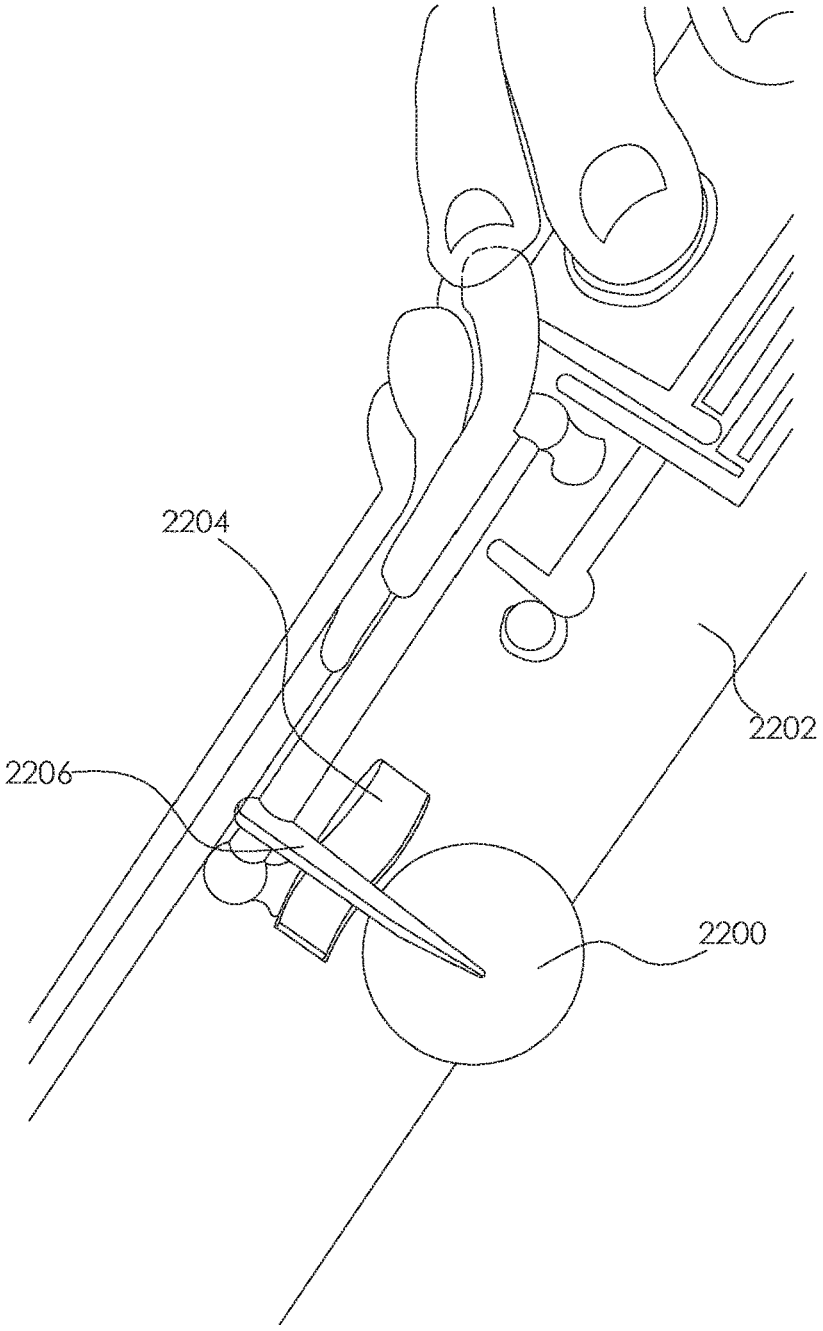
FIG. 22 illustrates a pad prop applied to the low G-sharp key of a bass clarinet.
Figure 23:
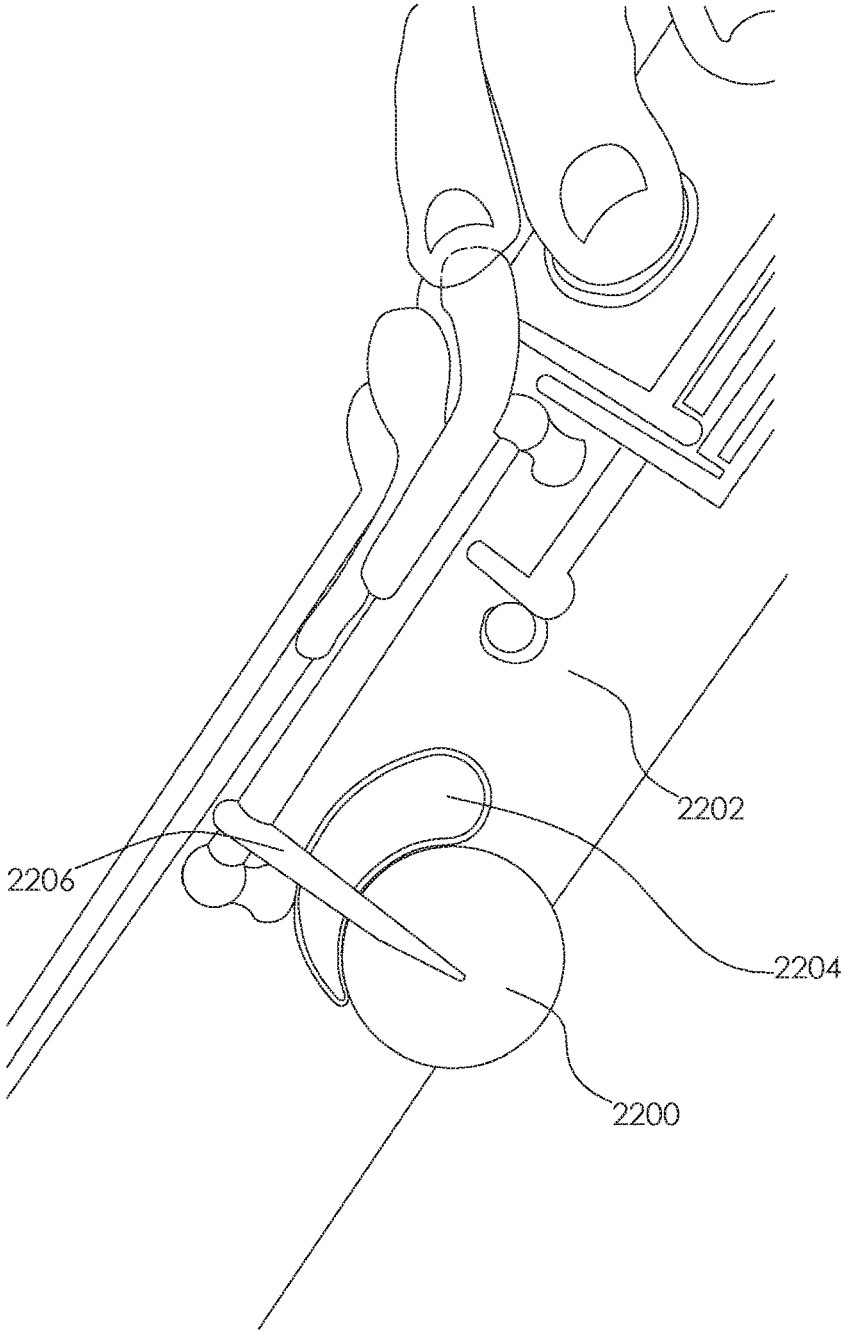
FIG. 23 illustrates an alternate pad prop orientation on the low G-sharp key of a bass clarinet.
Figure 24:
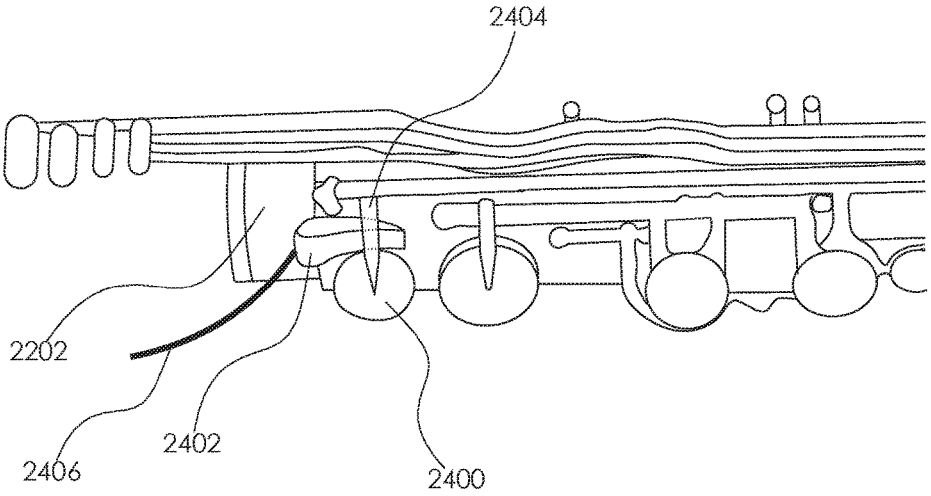
FIG. 24 illustrates a pad prop applied to the high G-sharp key of a bass clarinet.

FIGS. 17 and 18 illustrate a number of other nonexclusive pad prop placements that likewise serve to keep the low D-sharp and low C-sharp tenor saxophone pads raised. These placements and orientations may be applied to other keys and instruments. For example, with respect to a portion of an alto saxophone 1900 illustrated in FIGS. 19-21, the pad prop 1902 can be positioned in at least three different orientations so as to exert pressure or resistance against the key lever 1904 so as to raise the low C-sharp key cup 1906. FIGS. 22-24 illustrate possible pad prop orientations to raise the low G-sharp key cup 2200 and high G-sharp key cup 2400 on a bass clarinet 2202. As shown in FIG. 22, the small radius of pad prop 2204 is placed under the key arm 2206 and the large radius is against the body of the clarinet 2202, and in FIG. 23, the pad prop 2204 is placed on its side under the key arm 2206. Both placements prevent the low G-sharp key 2200 of the bass clarinet 2202, which is located in the lower joint of the bass clarinet 2202, from closing to its normally closed position. FIG. 24 illustrates the upper joint of the bass clarinet 2202, where the high G-sharp key cup 2400 is located and held open by the pad prop 2402 being placed under the key arm 2404, with the small radius under the key arm 2404 and the large radius against the body of the clarinet 2202. A linkage feature 2406 is also illustrated.

Figure 25:
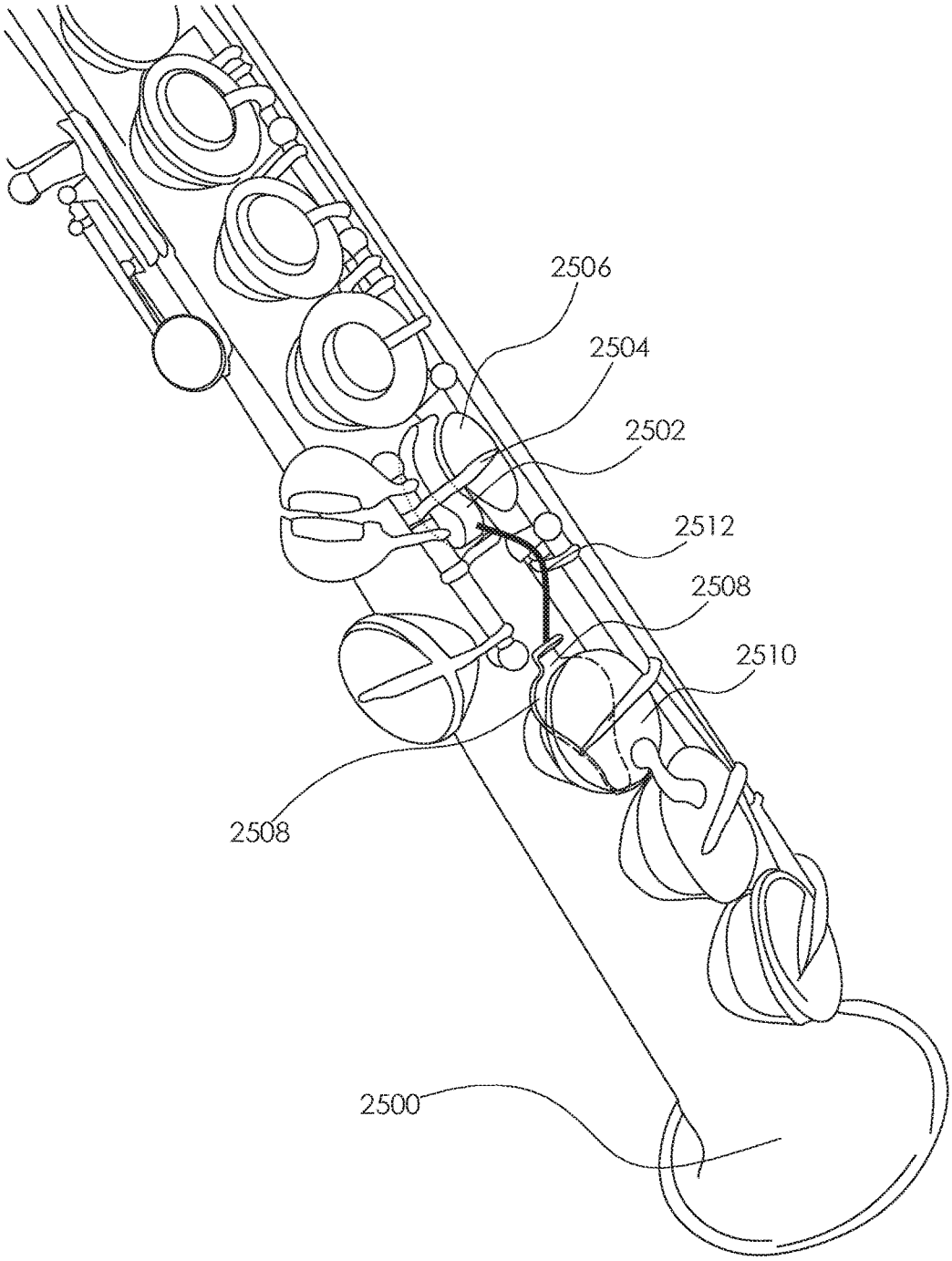
FIG. 25 illustrates a pad prop and vent spanner with a linkage feature, applied to a soprano saxophone.
Figure 26:
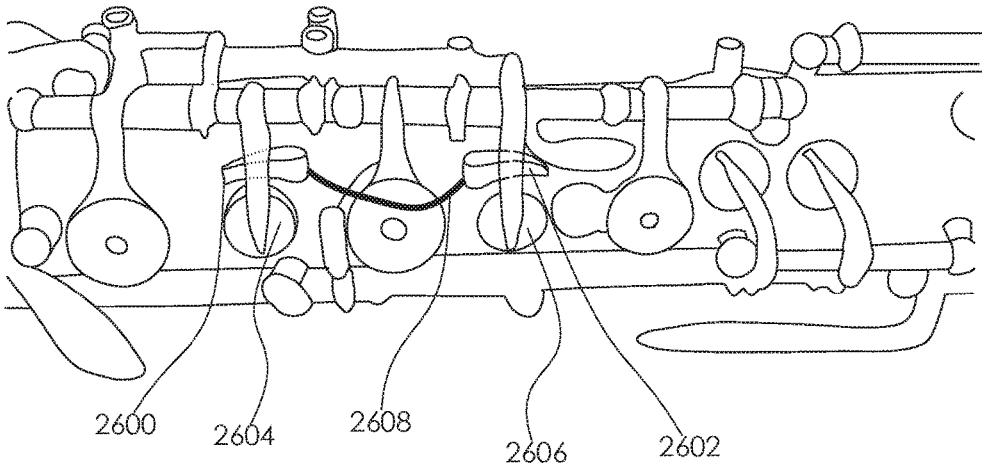
FIG. 26 illustrates pad props with a flexible linkage feature applied to an oboe.

FIG. 25 illustrates a portion of a soprano saxophone 2500 where pad prop 2502 is positioned under the key arm 2504 for the low D-sharp key cup 2506. The small radius of pad prop 2502 is against the key arm 2504 and the large radius is against the body of the soprano saxophone 2500. FIG. 25 also illustrates a vent spanner 2508 positioned between the low C-sharp pad and its related key cup 2510 and its corresponding vent. The vent spanner 2508 and the pad prop 2502 are connected via linkage feature 2512. In FIG. 26, pad props 2600 and 2602 are positioned to hold open the pad of the B-flat "vent key" 2604 and the pad of the C "vent key" 2606, respectively, with pad prop 2600 linked to pad prop 2602 by flexible linkage feature 2608. FIG. 27 shows the same pad props 2600 and 2602 being linked by a rigid linkage feature 2700.

Figure 35:
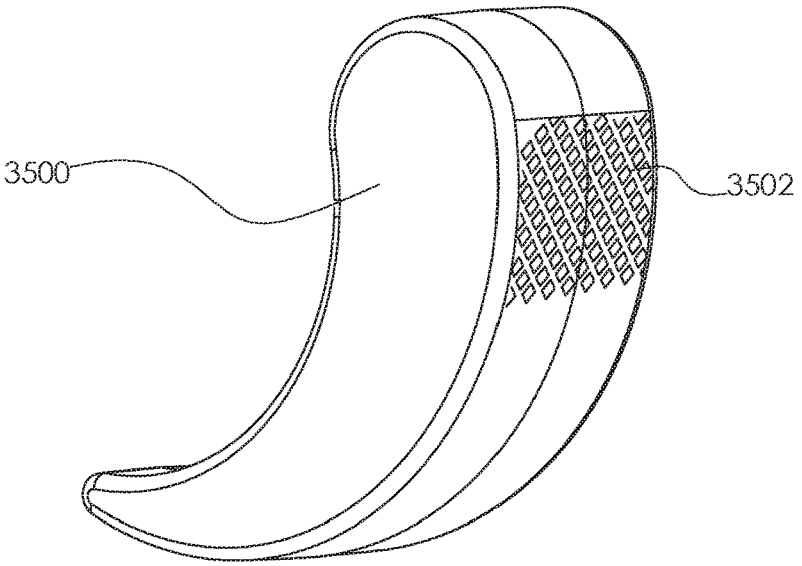
FIG. 35 illustrates a texturing design for a pad prop finger grip.
Figure 36:
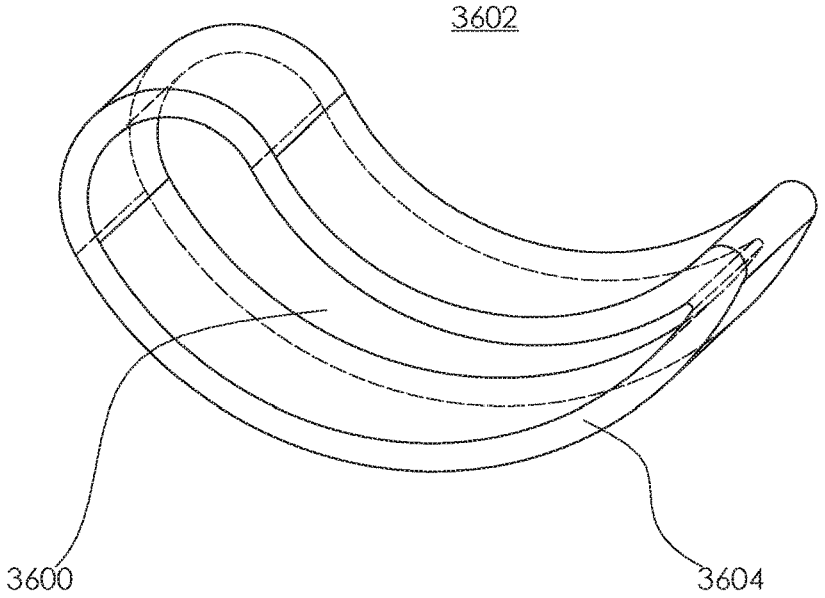
FIG. 36 illustrates a pad prop design with an exo-shape for 3D printing.
Figure 40:
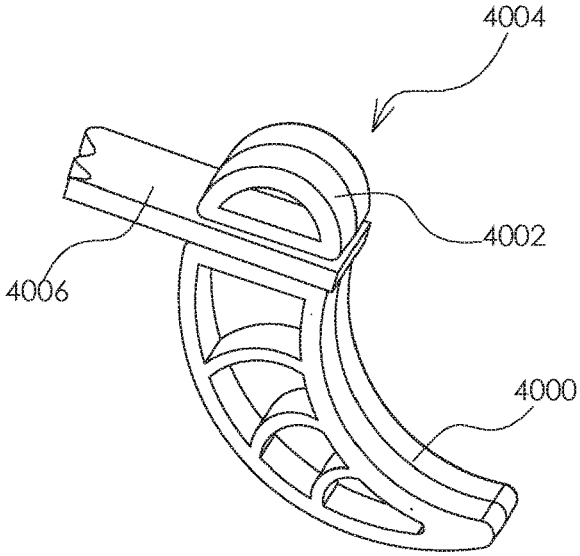
FIG. 40 illustrates a pad prop with cavities along an outer surface.

As illustrated in FIG. 35, the outer surface of a pad prop 3500 can include raised and/or depressed texturing 3502 to create a finger grip section for easier handling and so as to increase friction between the pad prop and the key mechanisms and/or the body. Although the texturing 3502 is shown on only one part of the pad prop 3500 in FIG. 35, texturing could be applied to any other part of the pad prop, multiple different parts of the pad prop, or the entirety of the pad prop. Pad props may also include, as illustrated and described above with respect to FIG. 15, one or more hollow areas 1502 that are formed within the interior area 1504 of the pad prop 1500. FIG. 36 illustrates an embodiment where a single cavity 3600 is formed within the interior of the pad prop 3602 by an exo-shape or outline structure 3604. The exo-shape 3604 may be formed in such a way, or from such a material, or both, that it retains its original shape when deformed, thereby springing back into shape. Varying degrees of rigidity may be used for the exo-shape 3604. As illustrated in FIG. 36, the opening goes all the way through the pad prop 3602 and as illustrated in FIGS. 15 and 40, the openings are only on one side of the pad props 1500 and 4000, respectively. In addition to improving a user's grip of the pad prop, the one or more openings may also improve gripping of the instrument body. Such openings, especially when only on one side of the pad prop, may also assist in positing or holding the pad prop in place by creating a suction against the instrument body. The one or more openings also facilitate a more cost-effective manufacturing design, such as FIG. 36 which exemplifies one example of a design based on 3D printing.

Figure 38:
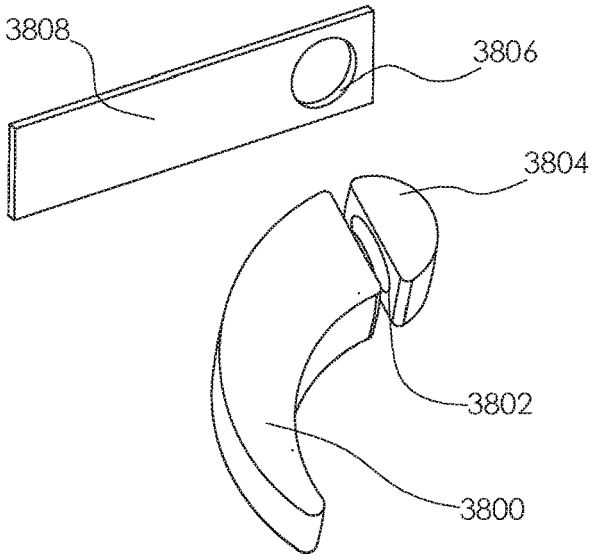
FIG. 38 illustrates a button top pad prop design and strap with button holes.
Figure 39:
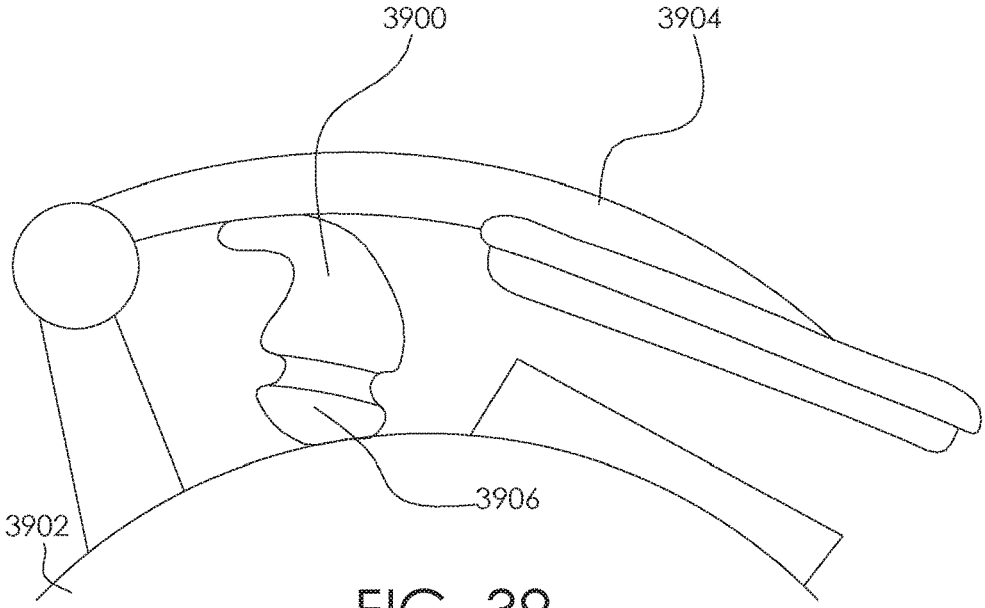
FIG. 39 illustrates a button top pad prop positioned beneath a key arm.
Figure 49:
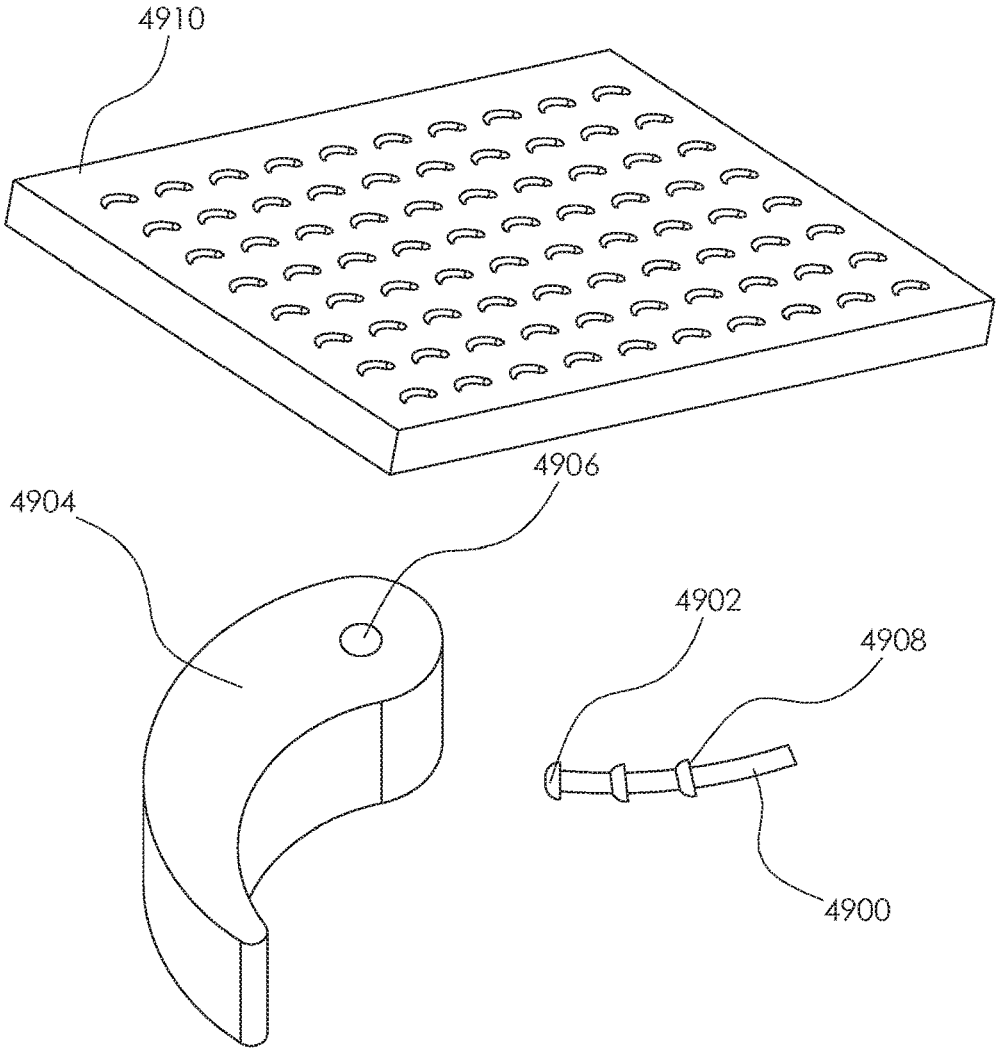
FIG. 49 illustrates a pad prop design with a button hole.

It should also be noted that pad prop 4000 in FIG. 40 includes a button top 4002 at the butt 4004 to which a linkage feature 4006 can be attached, which is further illustrated in FIG. 38. Depending on the material used to manufacture either the pad prop 4000 and/or the linkage feature 4006, such as a stretchy versus rigid material, the linkage feature 4006 can be removed from the pad prop 4000. For example, as illustrated in FIG. 38, the pad prop 3800 may be shaped with a recessed neck 3802 to form the button top 3804. The button top 3804 serves as a connection point to the button hole 3806 of strap linkage feature 3808. Alternatively, as shown in FIG. 49, the linkage feature 4900 may include a button top 4902, and the pad prop, such as pad prop 4904, may include a hole 4906 for accepting the button top. The linkage feature 4900 may also be formed of beaded cord including numerous beads 4908 spread evenly or not evenly along all or part of its length. As illustrated in FIG. 39, a button top may also provide additional orientations for a pad prop 3900, such as against the body tube 3902 or key arm 3904 so as to keep a key arm 3904 raised and its corresponding vent opened. As shown in FIG. 39, the button top is not fully dome shaped so as to create sufficient surface contact friction when positioned against an instrument body or key arm.

Figure 37:
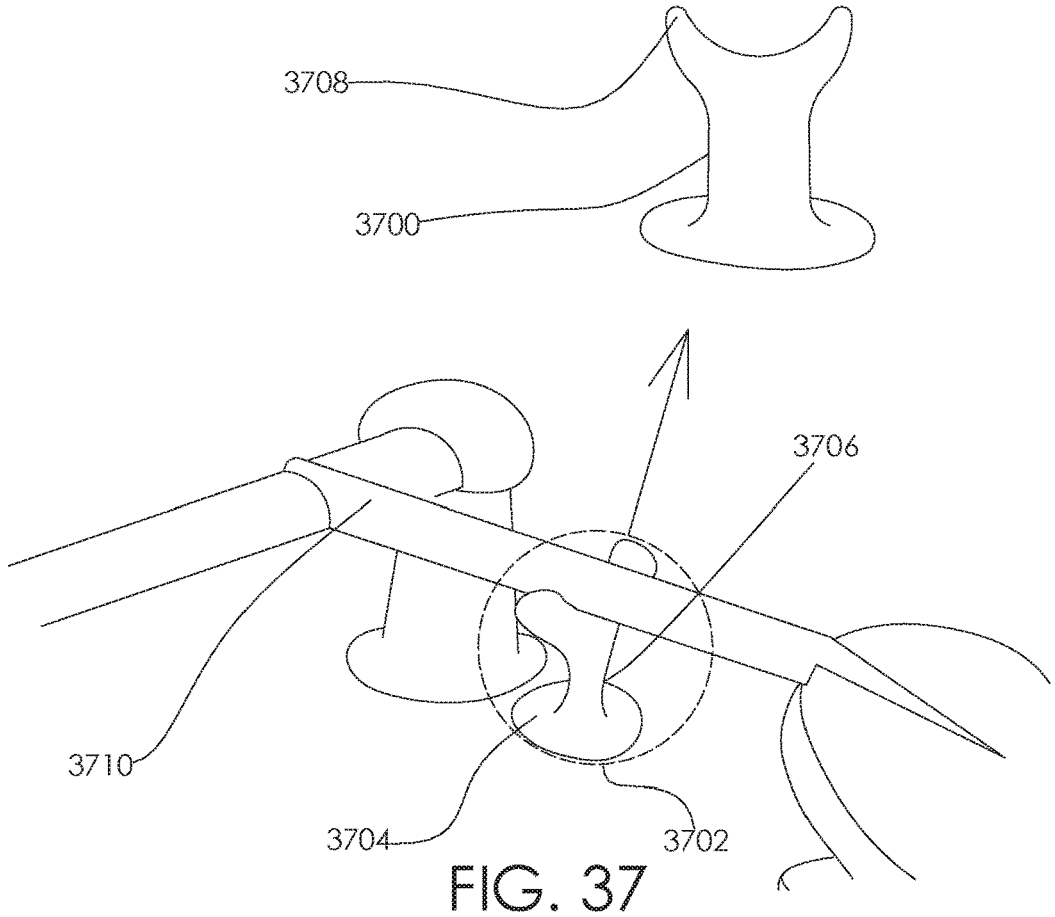
FIG. 37 illustrates a crutch-shaped pad prop.

In another embodiment, the pad prop 3700, circled by the dashed line 3702, and shown enlarged, is crutch-shaped, as seen in FIG. 37. In this design, the pad prop 3700 comprises a base 3704 that contacts the instrument's body, a middle portion 3706 extending upwards from the base 3704, and a head 3708 that supports a raised position of the key mechanism 3710 when placed beneath a key arm. The base 3704 may be a suction cup, in order to better secure the pad prop 3700 to the instrument body, and can be designed or comprised of any of the materials or designs discussed herein to improve contact and grip with the instrument body. Due to varying key arm sizes and distances from the instrument body, multiple pad prop sizes like pad prop 3700 may be necessary to keep the pad raised, and vent opened. Similarly, key arms vary in weight and compression force, with some key arms requiring a more rigid pad prop material to support the key arm.

Figure 41:
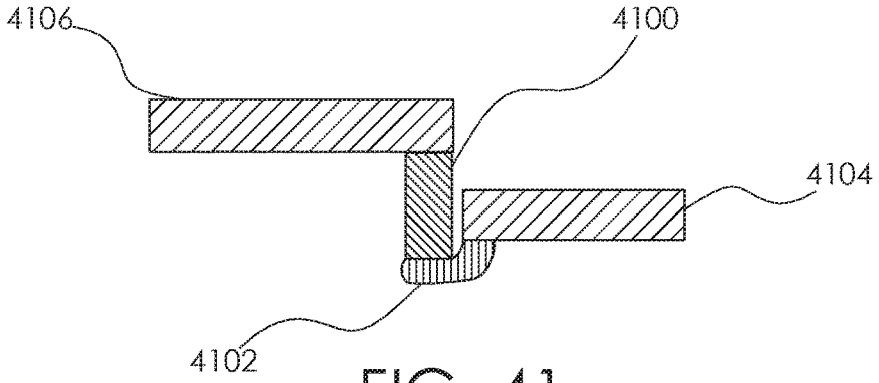
FIG. 41 illustrates a wedge shaped pad prop.
Figure 42:
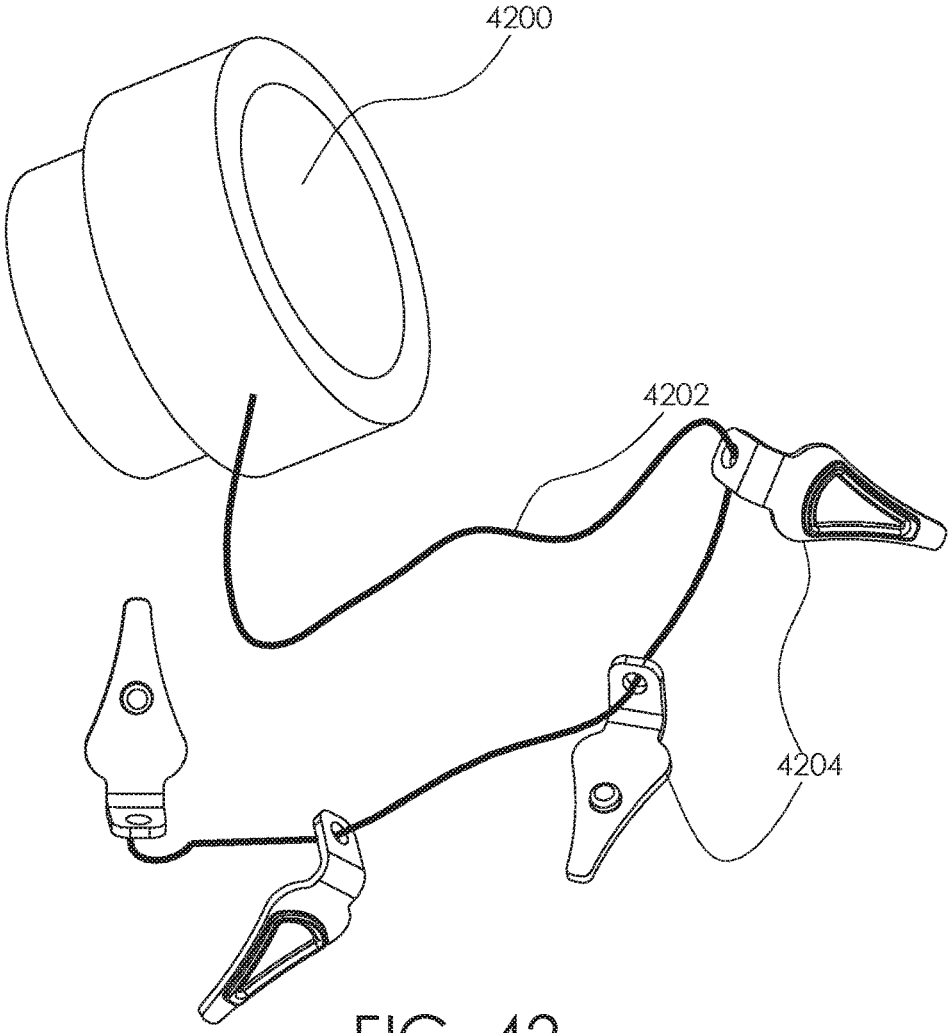
FIG. 42 illustrates vent spanners and a linkage feature connected to an end plug.

Another alternative embodiment includes a wedge or other shaped pad prop 4100 that fits between the top of the G-sharp tab 4102 (mounted under the G-sharp key touch 4104) and the bottom of the low C-sharp key touch 4106, such as illustrated in FIG. 41. In this embodiment, the pad prop 4100 can be used to release the auxiliary key mechanism that opens the G-sharp key cup, which tends to be the key pad most prone to sticking on the vent. This embodiment is especially useful for tabbed key mechanism applications and provides an alternative to using a pad prop on other areas of the key mechanism. The pad prop 4100 may be made of any of the pad prop materials or methods described herein.

Figure 43:
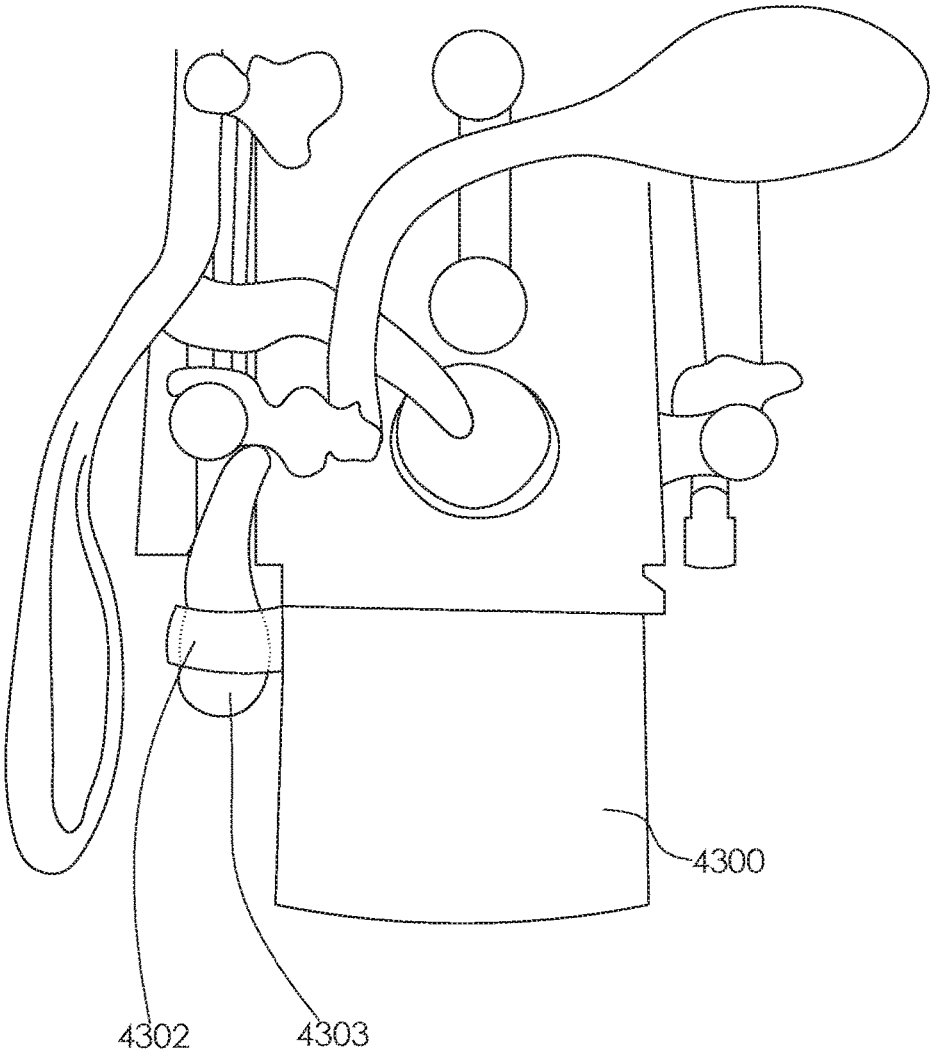
FIG. 43 illustrates a pad prop stored on a tenon cap.
Figure 44:
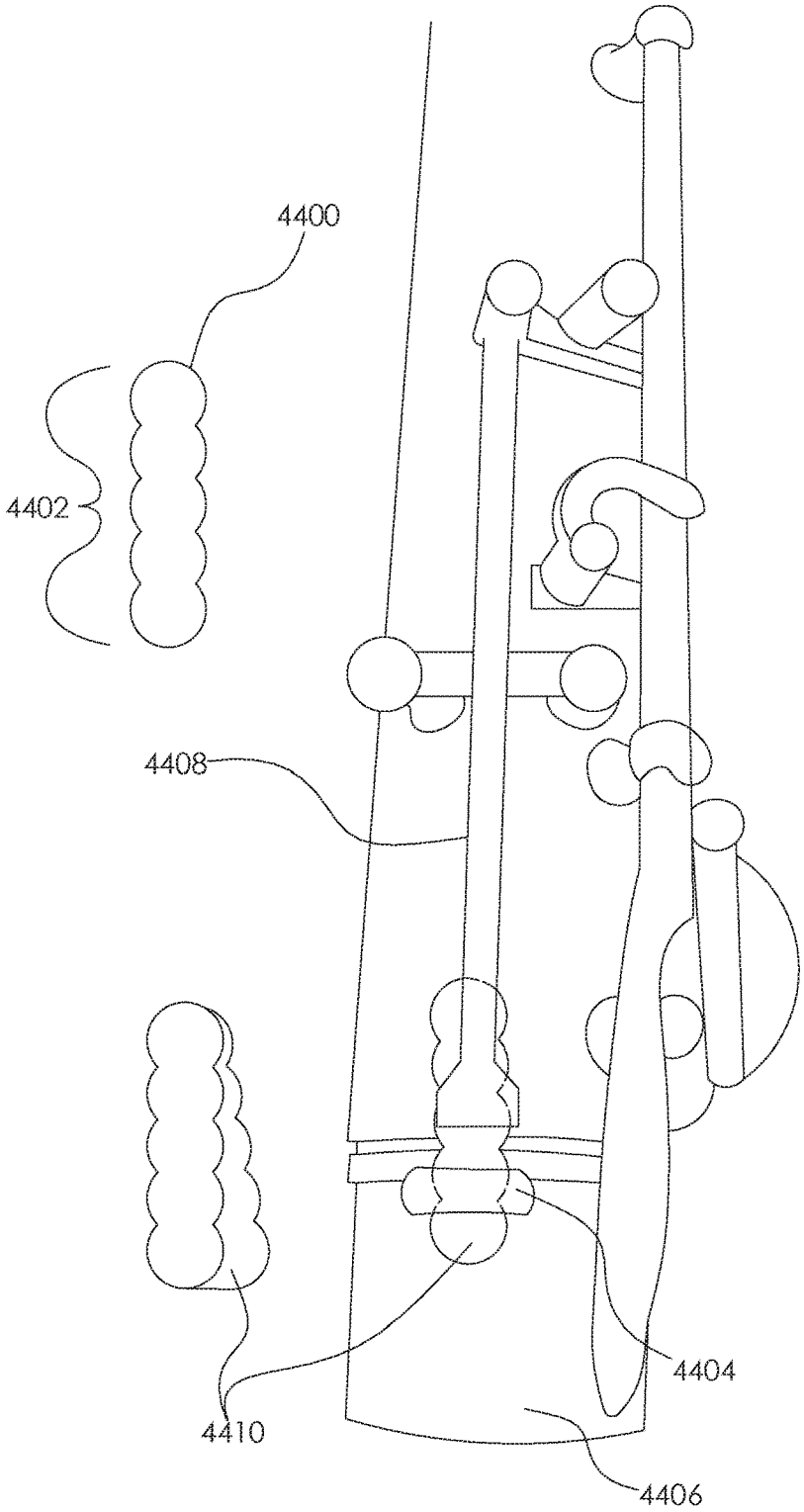
FIG. 44 illustrates contoured pad props and an adjustable pad prop holder linkage.
Figure 45:
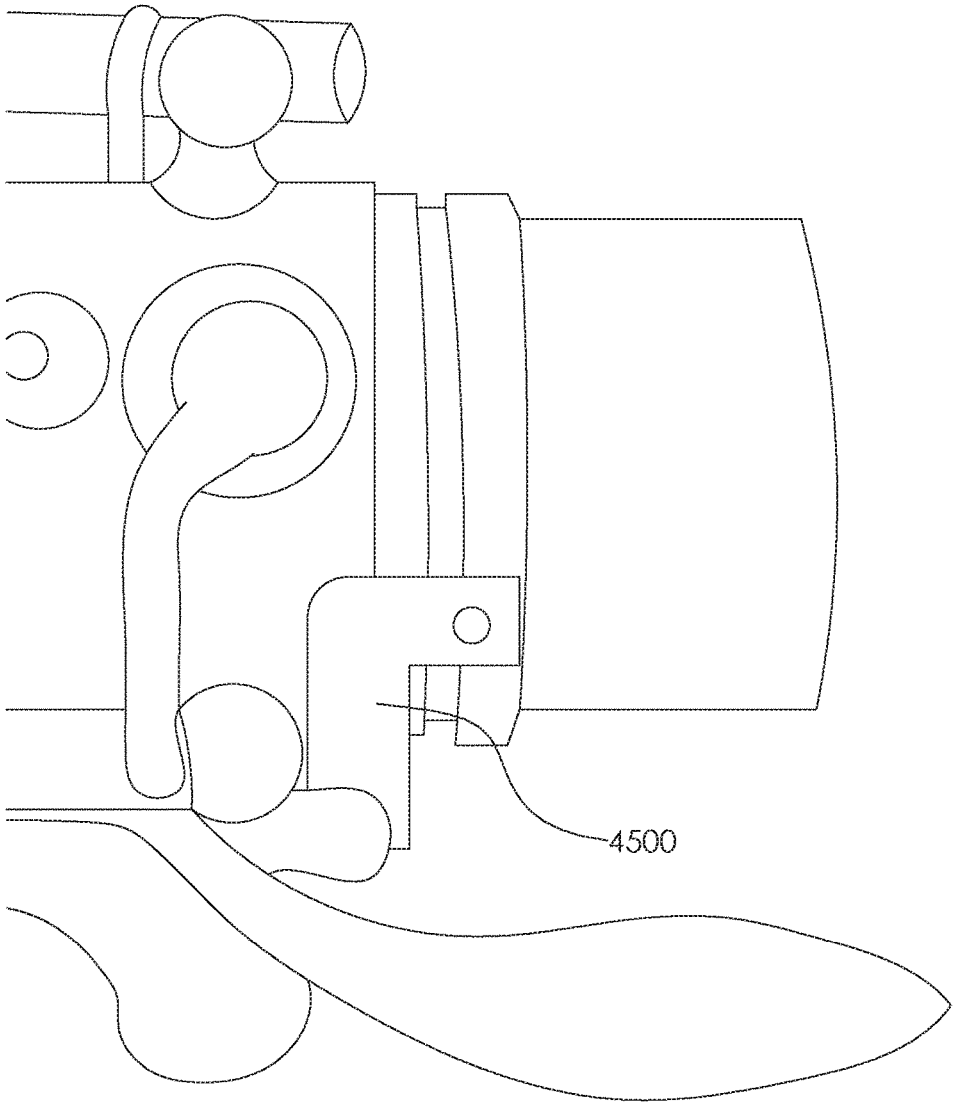
FIG. 45 illustrates an L-shaped pad prop and holder linkage.
Figure 46:
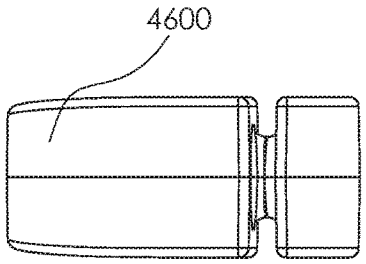
FIG. 46 illustrates a tapered pad prop design.
Figure 48:
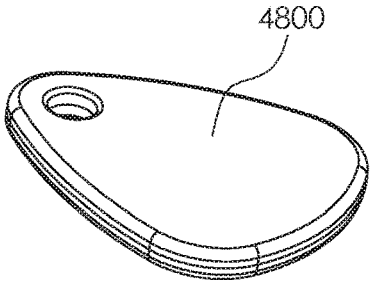
FIG. 48 illustrates a finger tab end piece design.

In another embodiment, illustrated in FIGS. 42, 43 and 57-59, pad props and vent spanners may be linked to an end piece 4200 or tenon cap 4300 when an instrument is transported, stored, or is not being played. As shown, in FIG. 42, the end piece of a saxophone 4200 is connected to a linkage feature 4202 connected to a number of vent spanners 4204. As shown in FIG. 43, the oboe top joint tenon cap 4300 includes an adjustable holder linkage 4302 and pad prop 4303, which may be made out of pad prop material or other suitable material. Adjustment contours can be added to a pad prop. For example, as shown in FIG. 44, a flat pad prop 4400 with adjustment contours 4402 may be fit between adjustable holder linkage 4404 of the end piece tenon cap 4406 to position the top joint auxiliary lever 4408, which will hold open the C "vent key" and B-flat "vent key" of the top joint (both shown in FIG. 27 as 2606 and 2604 respectively). Alternatively, the pad prop 4410 may be contoured to increase the tension that can be exerted against the top joint auxiliary lever 4408. Flat pad props with adjustable contours may improve fit, contact friction, and versatility of use between different instruments. In one example, adjustment contours allow the pad prop to tension fit into the opening of the holder linkage, as shown in FIGS. 43 and 44. As illustrated in FIG. 43-46, the pad prop may also be L-shaped 4500 and/or tapered 4302, 4410 and 4600. An alternative to an end piece or tenon cap, a finger tab 4800, is illustrated in FIG. 48.

Figure 57:
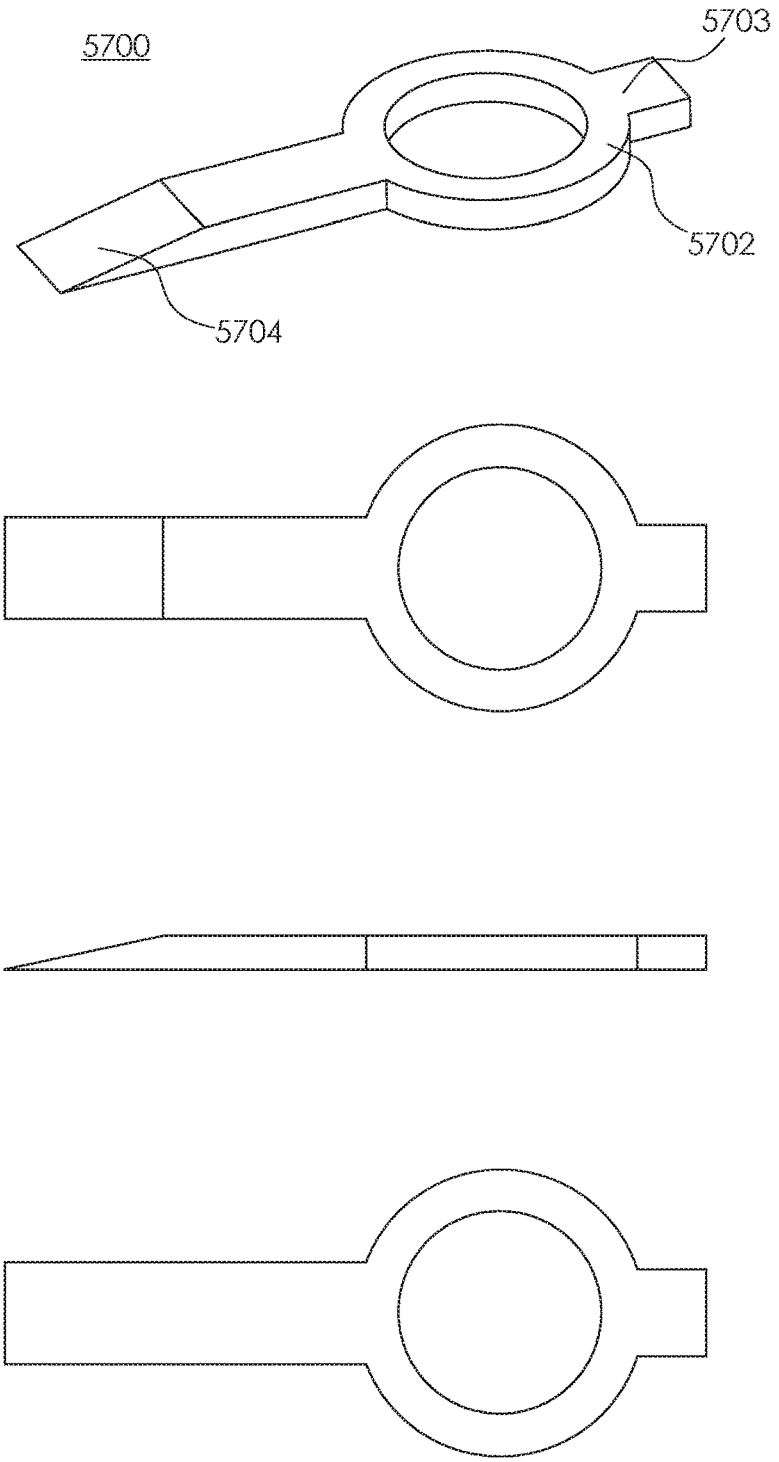
FIG. 57 illustrates a wedge-shaped pad prop with a removable linkage feature for an end piece or tenon.
Figure 58:
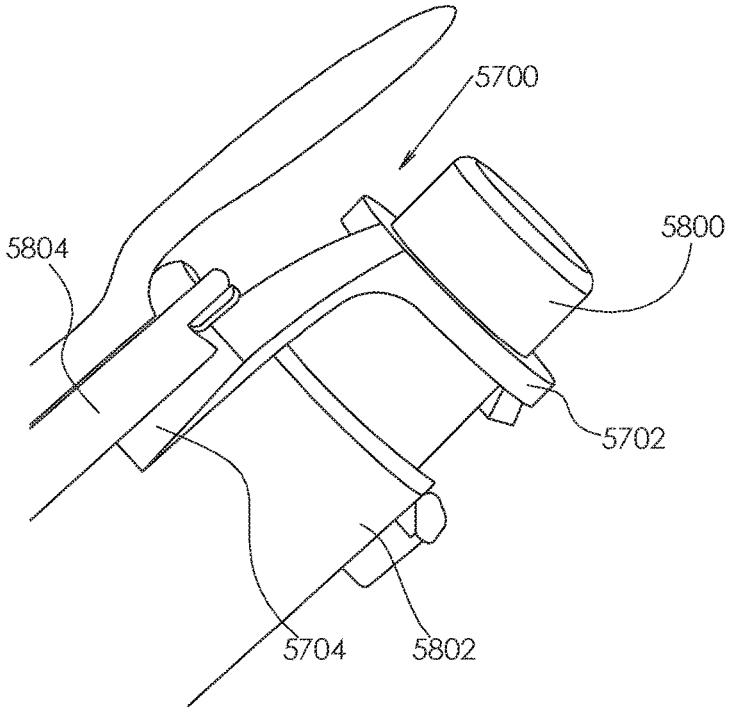
FIG. 58 illustrates a wedge-shaped pad prop with a removable linkage feature attached to an oboe tenon.
Figure 59A:
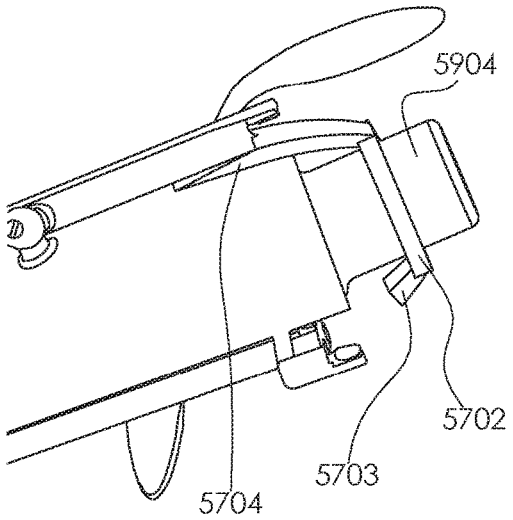
FIGS. 59A and 59B illustrate a wedge-shaped pad prop with removable linkage feature attached to a tenon cap for oboe.
Figure 59B:
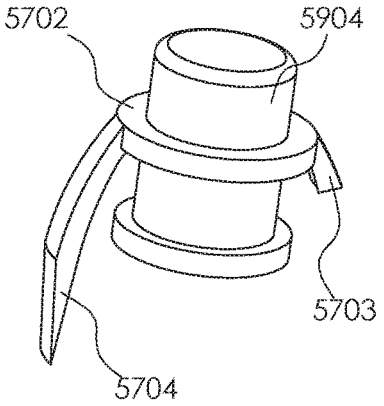

FIGS. 57-59 illustrate different views of a pad prop 5700 with an integrated linkage feature that is attachable to a body tenon or end piece. The pad prop includes an O-ring-like feature 5702 that may be slipped over a tenon or other end piece and used to position the pad prop 5700 so that the pad prop portion 5704 can be fit between key mechanisms and/or the key mechanism and the body. A finger tab 5703 is also included for ease of handling. As shown in FIG. 58, the O-ring 5702 of the pad prop 5700 has been fit over the body tenon 5800 of an oboe top joint and the pad prop portion 5704 has been fit between the body 5802 and a key mechanism 5804, thereby causing one or more corresponding pads to be raised and held in a fixed position elsewhere along the musical instrument. Another embodiment of a pad prop is better illustrated in FIGS. 59A and 59B, in which the O-ring 5702 is positioned over a tenon cap end piece 5904 and the pad prop portion 5704 extends down toward the key mechanism (as shown in FIG. 58). A finger tab 5703 is added to make it easier to install or remove the O-ring 5702 from the end piece 5904 or body 5800.

Figure 47:
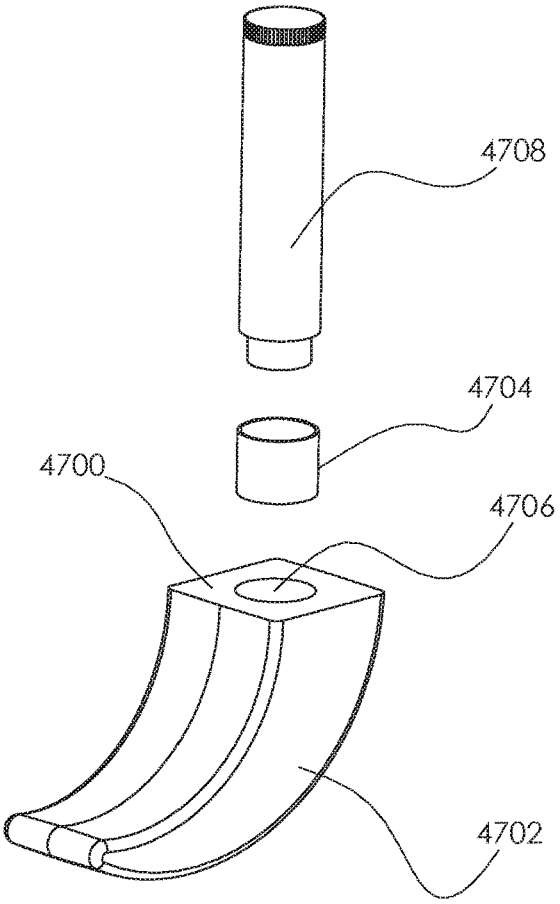
FIG. 47 illustrates a pad prop design with storage features.

Pad props may also serve as a container for small items related to the instrument. In an embodiment, illustrated in FIG. 47, the end 4700 of a pad prop 4702 contains a removable cap 4704 that may have a hollow area 4706 within the pad prop 4702 in which a container of cork grease 4708, oil, lube, etc can be stored. The cap 4704 may tension fit or screw into the pad prop 4702.

Linkage Feature

As noted above, one or more vent spanners and/or pad props may be connected by a linkage feature. The linkage feature unites the devices to decrease accidental loss of small parts, helps secure the devices to the instrument and adds material that the musician can hold when placing and removing the devices. A linkage feature may be flexible, such as a chain, string, cord, elastic band, etc., or may be rigid, via rods or other armatures that substantially match the configuration of specific instrument bodies and key mechanisms, such as illustrated in FIG. 27 or FIGS. 57-59.

As noted, in an embodiment, the linkage feature may be a strap with holes to fit the recessed neck 3802 and button top 3804 of pad prop 3800 that accommodate the holes in the strap, as shown in FIG. 38. The strap 3808 may have multiple holes, such as hole 3806 and pad props may be interchangeable among the various holes in the strap, as well as easily removed and attached, to allow for customization and adaptability to multiple instruments. The strap is fully rotatable around the pad prop neck 3802, to accommodate various linkage angle options. Conversely, the pad prop can have a hole in which to accept a button head on the strap, such as shown in FIG. 49.

Figure 50:
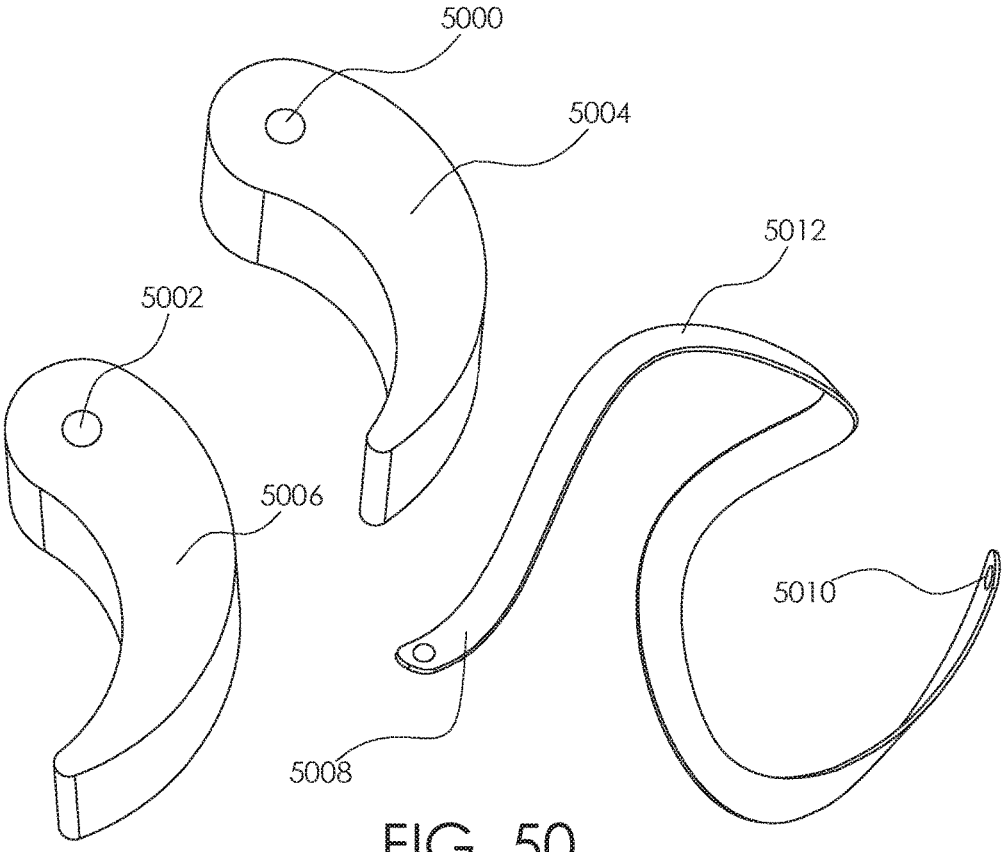
FIG. 50 illustrates a magnetic pad prop and linkage feature design.
Figure 51:
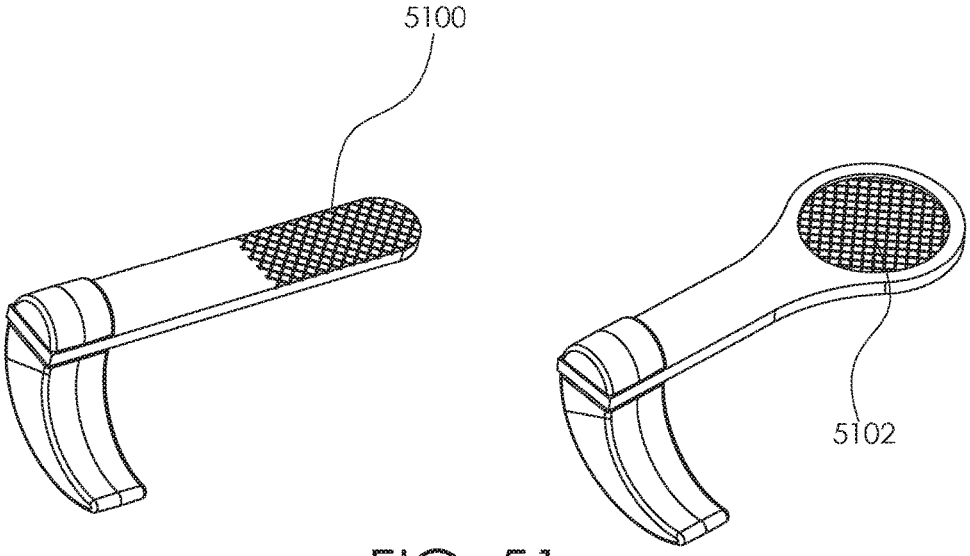
FIG. 51 illustrates a linkage feature design with texturing and/or fabric.

In another embodiment, the pad prop and strap may each contain magnets to connect the components together. For example, as illustrated in FIG. 50, the magnets 5000 and 5002 of the pad props 5004 and 5006, respectively, may magnetically connect to the magnets 5008 and 5010 in the strap 5012. In each of the disclosed embodiments, the strap can be made of any material, such as leather, rubber, silicone, plastics, nylon webbing, ripstop, or other fabrics. The strap may also include space for logos, product information, and labels. As shown in FIG. 51, the strap can include a textured surface 5100, with and without treated fabric and material inserts 5102, that improve grip and may be used to clean dirty pads and vents. In an embodiment, the strap may be a thin elastic material. To prevent possible damage to the strap, pad props, or instrument, the strap's design and elastic properties my enable the release of the pad prop's button top if overstretched.

Figure 52:
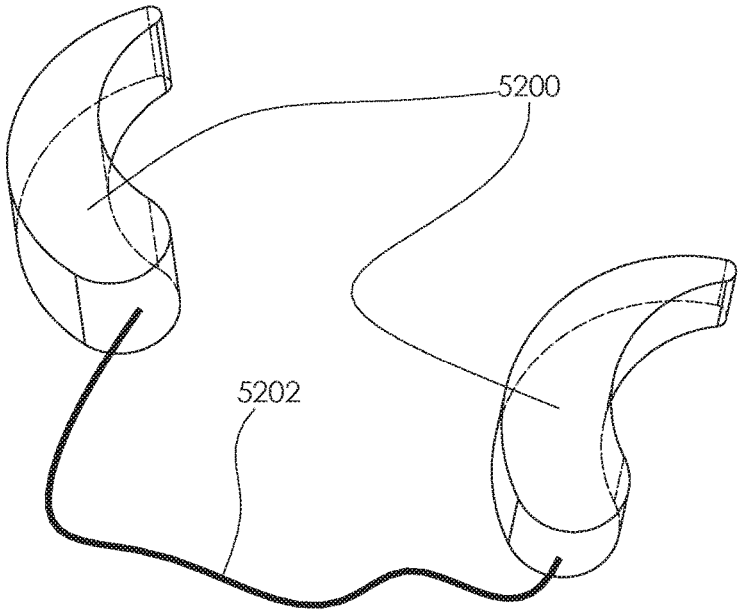
FIG. 52 illustrates a design showing a pad prop over molded on a linkage feature.
Figure 53:
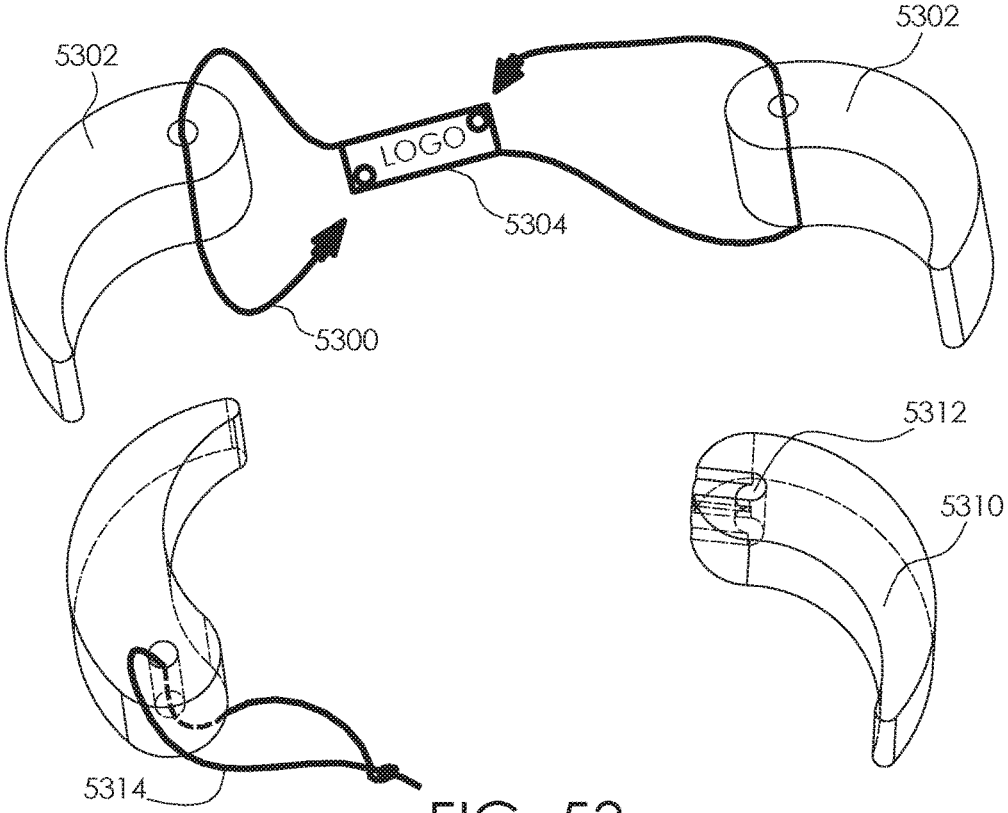
FIG. 53 illustrates a pad prop and linkage feature design.
Figure 54:
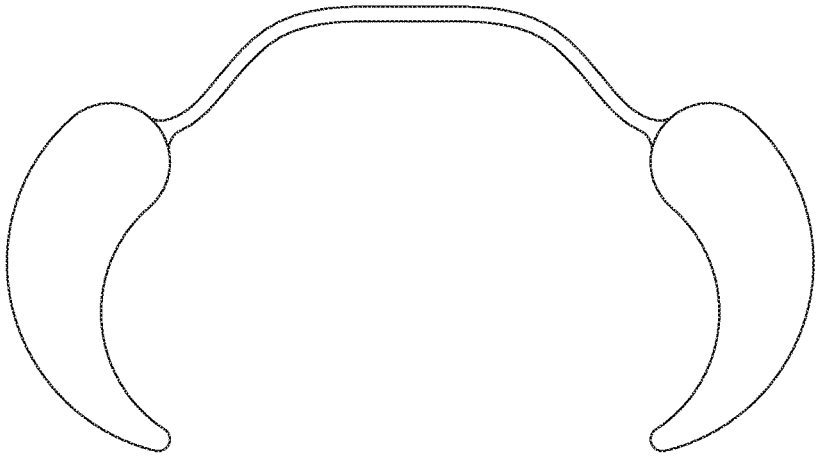
FIG. 54 illustrates a unitary pad prop and linkage feature design.

Pad props for these, and other, embodiments can be stamp cut from sheets of material, such as foam or cork, such as sheet 4910 of FIG. 49. In one example, as illustrated in FIG. 52, pad props 5200 are overmolded onto the cord 5202 of the linkage feature. In another embodiment, the cord may have a mechanical locking nut, ball, knot or similar device to attach to a hole or recess in the pad prop, similar to FIG. 49. Another embodiment uses a cord 5300 that is part of a connector styled similar to a clothing hang tag, as shown in FIG. 53, which is wound through holes in corresponding pad props 5302 as shown, and which may include a connector 5304 with room for a logo, branding or other information. In an embodiment, the pad prop 5310 may include a slot in the butt and a recessed opening 5312 through which a loop 5314 from a strap may be inserted. In another embodiment, the pad prop and cord may be of unitary construction where all parts are made of the same material (FIG. 54).

Figure 55:
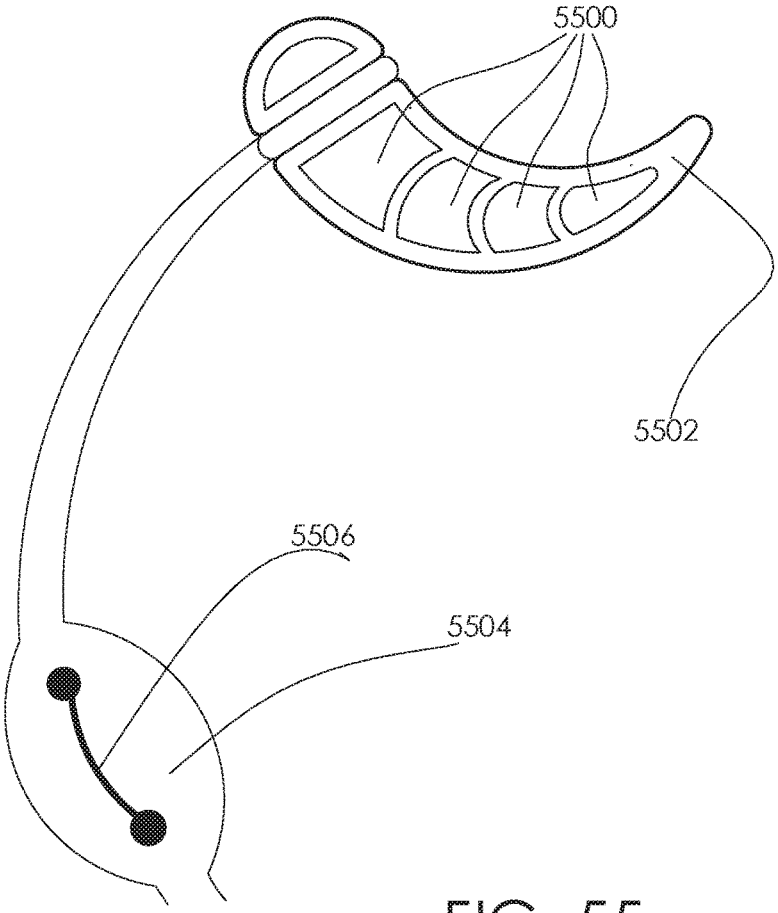
FIG. 55 illustrates a pad prop and linkage feature design with storage.

A pad prop and linkage feature may also be used for storage. As illustrated in FIG. 55, cavities 5500 formed in the pad prop 5502 may contain dehumidifying agents such as desiccant packets that help the instrument dry or aromatic agents to introduce pleasant odors. As also illustrated in FIG. 55, the strap may include a pouch 5504 that may contain but is not limited to desiccant, air fresheners, etc., that can be accessed through a slotted opening 5506.

All devices and features described in the current disclosure can be made of materials including but not limited to: wood, cork, metal, polymeric material, plastic, rubber, silicone, silica or other desiccants, resin, paper, fiber, textile, cloth, leather, bone, stone, mineral, magnetic materials, composite or additive manufacturing processes. For example, eco-friendly and/or cost-efficient materials, such as bamboo may be used. For another example, as previously mentioned, anti-bacterial and anti-microbial materials such as silver-ion derived anti-microbial plastics could be used to further retard bacterial growth on the instrument or devices.

Figure 56:
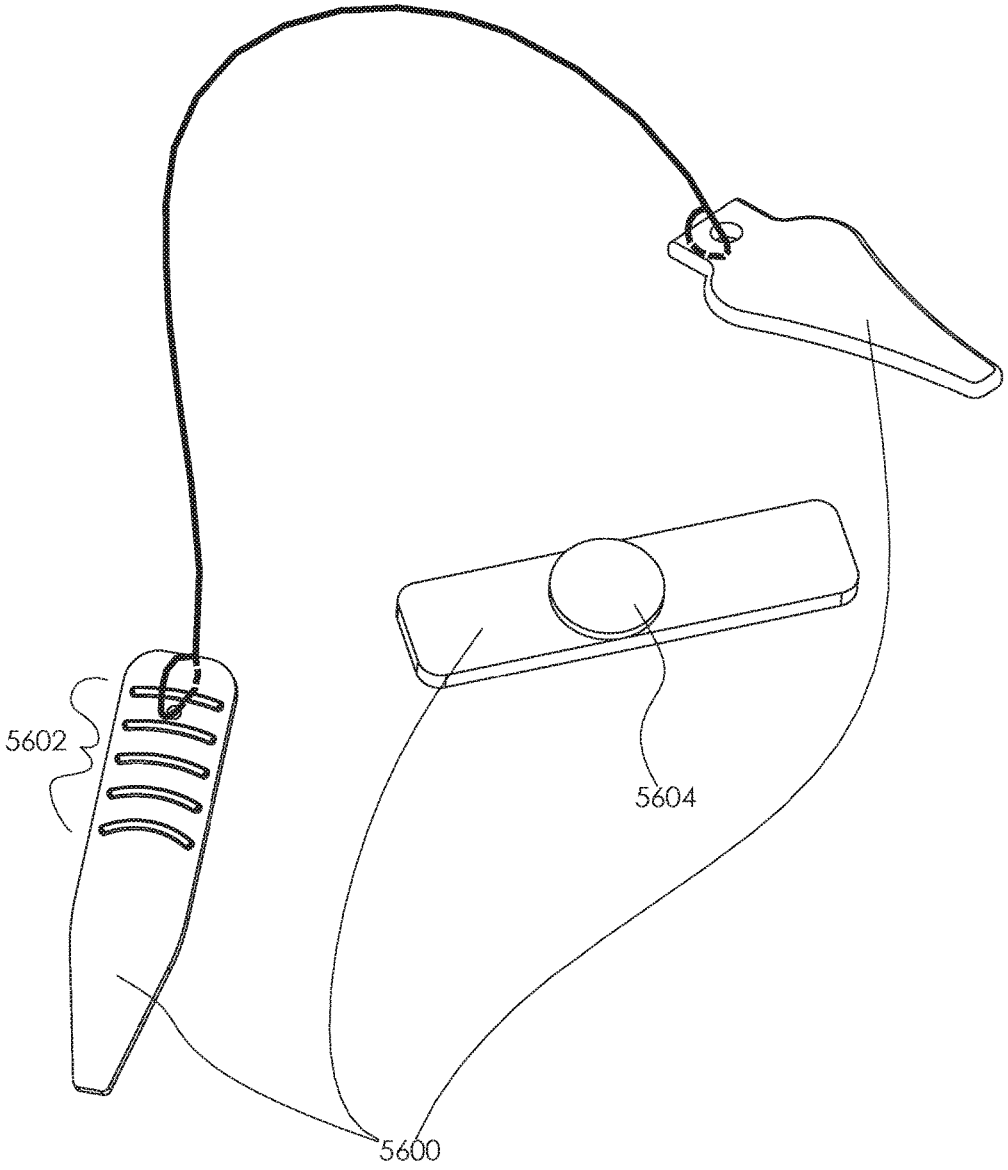
FIG. 56 illustrates a vent spanner manufactured of sustainable materials with and without a retention feature and with and without a protuberance serving as positioning feature.

Vent spanners 5600 illustrated in FIG. 56 may be made of bamboo and include texturing 5602 to enable one or more features (e.g., vent centering features, linkage features, prevent slippage, etc.). In the same manner previously described, protuberances and vent centering features, such as protuberance 5604 may be affixed to a vent spanner, such as through domed stickers that attach to the vent spanner or through other methods.

The devices and methods described above may be applied to vents, pads, and key mechanism of many different types of musical instruments including, but not limited to:

SAXOPHONES
High closed keys, such as high D key and above
Side closed keys, such as side C, side A-sharp, and alternate F-sharp
G-sharp key
Low D-sharp key
Low C-sharp Key
OBOE
Semi-automatic octave systems
B-flat "vent key" of top joint
C "vent key" of top joint
Top joint auxiliary lever that opens the B-flat "vent key" and C "vent key".
G-sharp key of the top joint
Low E-flat key of the bottom joint
Low C-sharp key of the bottom joint
CLARINET
E-flat/B-flat key of upper joint
Alternate F-sharp key of upper joint
B-flat trill key of upper joint
B trill key of upper joint
Throat A key of upper joint
Low C-sharp/High G-sharp key of upper joint
Low F-sharp key of lower joint
Low G-sharp/D-sharp key of lower joint
"Sliver"/"Banana" Key of lower joint
BASS CLARINET
Thumb register vent key
Thumb B-flat vent key of upper joint
Throat A key of upper joint
Low C-sharp/High G-sharp key of upper joint
Low G-sharp/D-sharp key of lower joint
BASSOON
Flick B-flat Key on wing joint
Flick A key on wing joint
Low D-flat key on long joint
Low E-flat key on long joint
Middle/High C-sharp key on wing joint
Right hand middle finger ring key (High G)
FLUTE
G-sharp key
Trill keys including the right hand trill keys and the C-sharp trill key
D-sharp key
BRASSWIND INSTRUMENTS
Water keys commonly found on most brass instruments
Keyed Brass Instruments, such as the keyed trumpet, that make use of vented openings in its bore rather than extensions of the length of the bore as the means of playing all the notes of the chromatic scale.

In an embodiment, a vent spanner for a musical instrument comprises a vent spanner section configured to contact a vent of a body of the musical instrument and to raise a pad for sealing the vent, the vent spanner section having one or more of a positioning feature and a retention feature, the vent spanner section being configured to prevent the pad from sealing the vent and to increase air flow around the pad and body.

In the embodiment, the vent spanner section includes a first surface and a second surface substantially opposite the first surface, the positioning feature including one or more of a visual indicator on one or more of the first surface and the second surface, a textured pattern on all or part of one or more of the first surface and the second surface, and one or more raised or depressed areas on all or part of one or more of the first surface and the second surface. In the embodiment, wherein the one or more raised areas include a protuberance positioned to engage a portion of one or more of the pad and a resonator. In the embodiment, wherein the one or more raised areas include a protuberance, and wherein a position of the protuberance is movable along the first surface. In the embodiment, wherein the first surface includes a slot formed in the first surface in which the protuberance is movably positioned. In the embodiment, further comprising a retention feature on the second surface, wherein the second surface further includes the slot, wherein the retention feature includes at least one protuberance for engaging the vent, and wherein the at least one protuberance is movably positionable within the slot.

In the embodiment, wherein the protuberance is removable connected to the first surface. In the embodiment, wherein the protuberance includes a plurality of interchangeable protuberances, wherein each protuberance is of a different size. In the embodiment, wherein the protuberance includes a spring.

In the embodiment, wherein the vent spanner section includes a first surface and a second surface substantially opposite the first, the retention feature including one or more of a textured pattern on all or part of one or more of the first surface and the second surface, one or more raised or depressed areas on all or part of one or more of the first surface and the second surface, a material forming one or more of the first surface and the second surface that configures one or more of the first surface and the second surface to exert sufficient friction on the vent to prevent the vent spanner from slipping out between the vent and the pad, and a material coating one or more of the first surface and the second surface that configures one or more of the first surface and the second surface to exert sufficient friction on the vent to prevent the vent spanner from slipping out between the vent and the pad.

In the embodiment, wherein vent spanner section includes a first surface and a second surface, wherein the first surface and the second surface have sides along a length of the vent spanner section, wherein first surface includes a raised area along all or part of the first surface, and wherein one or both of the first surface and the second surface's sides are configured to engage the vent as the retention feature.

In the embodiment, further comprising a handle connected to the vent spanner section.

In the embodiment, wherein the retention feature is configured to engage a vent and position the vent spanner section in relation to the vent. In the embodiment, wherein the vent spanner section includes a vent facing surface and the retention feature includes one or more raised areas positioned on the vent facing surface to be inside or outside of the walls of the vent. In the embodiment, wherein the vent spanner section includes a vent facing surface and the retention feature includes at least one depressed area in the vent facing surface.

In the embodiment, further comprising a linkage feature configured to be connected to either the vent spanner section or to a handle connected to the vent spanner section. In the embodiment, wherein the linkage feature includes a string, a strap, a cord, a chain, a beaded cord, or a rigid member. In the embodiment, wherein the linkage feature is connected to one or more of an additional vent spanner, a pad prop, an end piece, a key mechanism and the body of the musical instrument. In the embodiment, wherein the linkage feature includes at least a partially textured surface. In the embodiment, wherein the linkage feature includes a storage area.

In the embodiment, wherein the vent spanner section varies in thickness along a length. In the embodiment, wherein the vent spanner includes a storage area.

In an embodiment, a pad prop for a musical instrument comprises a structure other than part of the musical instrument that when placed in contact with a key mechanism of the musical instrument or the key mechanism and a body of the musical instrument, wherein the key mechanism does not include the key touch, provides sufficient structural support to raise at least one pad connected to the key mechanism sufficient to create an air gap between the at least one pad and a vent of the body of the musical instrument corresponding to the at least one pad, and maintains the at least one pad in a substantially fixed open position during storage or movement of the musical instrument.

In the embodiment, wherein the structure is tapered. In the embodiment, wherein the structure includes substantially opposing longitudinal flat surfaces and substantially orthogonal opposing tapered sides. In the embodiment, wherein the structure includes a tip, a butt and a middle and is curved to create a small radius and a large radius on substantially opposing sides of the middle. In the embodiment, wherein the structure further includes substantially opposing flat sides orthogonal to the substantially opposing curved sides of the middle. In the embodiment, wherein the material of the structure is based on the structure being formed from one or more of cutting, molding, printing and stamping. In the embodiment, wherein the structure includes a tip, a butt and a middle, and the butt is substantially curved.

In the embodiment, wherein the structure includes a tip, a butt and a middle and the butt is separated from the body of the musical instrument by a recessed neck to form a button top. In the embodiment, wherein the button top is substantially dome shaped and/or textured to increase surface contact and mechanical friction. In the embodiment, wherein a linkage feature engages with the recessed neck and connects the pad prop to one or more of another pad prop, a vent spanner, an end piece, the key mechanism or the body of the musical instrument.

In the embodiment, wherein the structure includes a base that contacts the body of the musical instrument; a middle portion extending upwards from the base; and a head supporting a raised position of the key mechanism when placed beneath the key mechanism. In the embodiment, wherein the head is curved and configured to hold the key mechanism within the curve. In the embodiment, wherein the base includes a suction cup. In the embodiment, wherein the structure includes one or more interior openings formed by walls of the structure. In the embodiment, wherein one or more of a dehumidifying agent and an aromatic agent is stored in the one or more interior openings. In the embodiment, wherein the structure includes an inner, hollow storage area. In the embodiment, wherein a removable cap screws or tension fits into the structure.

In the embodiment, wherein one or more surfaces of the structure include texturing. In the embodiment, wherein the structure is L-shaped.

In the embodiment, wherein a linkage feature engages with the structure and connects the pad prop to one or more of another pad prop, a vent spanner, an end piece, the key mechanism, and the body of the musical instrument. In the embodiment, wherein the linkage feature includes one or more of a string, a strap, a cord, a chain, and a rigid member. In the embodiment, wherein the linkage feature includes at least a partially textured surface. In the embodiment, wherein the linkage feature includes a storage area. In the embodiment, wherein the linkage feature includes a member that engages at least a portion of the body of the musical instrument and is configured to position the structure to engage the key mechanism.

Conditional language used herein, such as, among others, "can," "could," "might," "may," "e.g.," and the like, unless specifically stated otherwise, or otherwise understood within the context as used, is generally intended to convey that certain examples include, while other examples do not include, certain features, elements, and/or steps. Thus, such conditional language is not generally intended to imply that features, elements and/or steps are in any way required for one or more examples or that one or more examples necessarily include logic for deciding, with or without author input or prompting, whether these features, elements and/or steps are included or are to be performed in any particular example. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

While certain example or illustrative examples have been described, these examples have been presented by way of example only, and are not intended to limit the scope of the subject matter disclosed herein. Indeed, the novel methods and systems described herein may be embodied in a variety of other forms. The accompanying claims and their equivalents are intended to cover such forms or modifications as would fall within the scope and spirit of certain embodiments of the subject matter disclosed herein.

What is claimed:

1. A pad prop for a musical instrument, comprising:

a prop having a length, a width and a height sized for placement between a body of the musical instrument and a key mechanism of the musical instrument or for placement between two key mechanisms, wherein the key mechanism or at least one of the two key mechanisms operates a pad for a vent of the body of the musical instrument, wherein the length, the width and the height of the prop is sufficiently sized that when placed between the body of the musical instrument and the key mechanism or between the at least two key mechanisms the prop raises the pad sufficient to create an air gap between the pad and the vent and maintains the pad in a substantially fixed open position.

2. The pad prop of claim 1, wherein the prop is a wedge.

3. The pad prop of claim 2, wherein the wedge is comma-shaped, includes a tip, a butt and a middle positioned between the tip and the butt, and is curved to create a small radius and a large radius on substantially opposing sides of the middle.

4. The pad prop of claim 3, wherein the wedge further includes substantially opposing flat sides orthogonal to the substantially opposing sides of the middle.

5. The pad prop of claim 1, wherein the material of the prop is one or more of a cut, a molded, a printed and a stamped material.

6. The pad prop of claim 1, wherein the prop includes a tip, a butt and a middle positioned between the tip and the butt, and wherein the butt is substantially curved.

7. The pad prop of claim 1, wherein the prop includes a tip, a butt and a middle positioned between the tip and the butt, and wherein one or more recessed necks are formed between the middle and one or more of the tip or the butt.

8. The pad prop of claim 1, wherein at least a portion of the prop is textured to increase one or more of surface contact and mechanical friction.

9. The pad prop of claim 1, further comprising a linkage mechanism connected to the prop and connected to one or more of another prop, the key mechanism, at least one of the at least two key mechanisms, another key mechanism, the body of the musical instrument, and an object ancillary to the musical instrument.

10. The pad prop of claim 1, wherein the prop includes:

a base that contacts the body of the musical instrument;

a middle portion extending upwards from the base; and a head supporting a raised position of the key mechanism when the prop is placed beneath the key mechanism.

11. The pad prop of claim 1, wherein a portion of the prop is curved and configured to hold at least a portion of the key mechanism or the at least two key mechanisms within the curved portion.

12. The pad prop of claim 1, wherein the prop includes a suction cup.

13. The pad prop of claim 1, wherein at least a portion of the prop includes one or more of a solid interior, one or more interior openings formed by walls of the prop, and a storage area.

14. The pad prop of claim 1, wherein the prop includes an inner, hollow storage area.

15. The pad prop of claim 14, wherein the storage area includes one or more of a dehumidifying agent, an antibacterial agent, a desiccant, and an aromatic agent.

16. The pad prop of claim 14, wherein a removable cap screws or tension fits into the storage area.

17. The pad prop of claim 1, wherein the prop includes one or more of a L-shape, a plurality of adjustment contours, a taper along at least a portion of the length, an extension perpendicular to the length, and an O-ring-shaped structure.

18. The pad prop of claim 9, wherein the linkage feature includes one or more of a string, a strap, a cord, a chain, and a rigid member.

19. The pad prop of claim 9, wherein the linkage feature includes a storage area.

20. The pad prop of claim 9, wherein the linkage feature includes a member that engages at least a portion of the body of the musical instrument, the key mechanism, or at least one of the at least two key mechanisms, and is configured to position the prop to engage the key mechanism.

21. The pad prop of claim 1, wherein the prop is curved along at least a portion of one or more of the length, the height and the width.

22. The pad prop of claim 1, wherein at least a portion of the prop is flexible or elastic.

23. A pad prop for a musical instrument, comprising:

a prop having a length, a width and a height sized for placement between a body of the musical instrument and a key mechanism of the musical instrument or for placement between two key mechanisms, wherein the key mechanism or at least one of the two key mechanisms operates a pad for a vent of the body of the musical instrument, wherein one or more of the length, the height and the width are configured to raise the pad and create an air gap between the pad and the vent, and wherein one or more of the length, the height and the width are configured to maintain the pad in a stable position against the body of the musical instrument and the key mechanism of the musical instrument or against the two key mechanisms.

24. The pad prop as recited in claim 23, wherein at least a portion of the prop is one or more of straight, L-shaped, contoured, and tapered.

25. The pad prop of claim 23, wherein the prop is directly or indirectly connected one or more of an L-shape extension to the musical instrument, an extension to the musical instrument substantially perpendicular to the length, an extension to the musical instrument substantially parallel to the length, an O-ring extension to the musical instrument, and a cylindrical extension to the musical instrument.

26. The pad prop of claim 25, wherein the prop is directly connected to the cylindrical extension via an adjustable holder formed between a portion of the cylindrical extension and a portion of the prop.

27. The pad prop of claim 25, wherein the prop is indirectly connected to the cylindrical extension via a flexible linkage mechanism.

28. The pad prop of claim 23, further comprising a flexible or rigid linkage mechanism connected to the prop and an object ancillary to the musical instrument.

29. The pad prop of claim 23, wherein the prop is curved along at least a portion of one or more of the length, the height and the width.

30. The pad prop of claim 23, wherein at least a portion of the prop is flexible or elastic.

* * * * *